US009097447B2

(12) United States Patent
Trawicki et al.

(10) Patent No.: US 9,097,447 B2
(45) Date of Patent: Aug. 4, 2015

(54) METHODS AND CONTROLLERS FOR PROVIDING A SURGE MAP FOR THE MONITORING AND CONTROL OF CHILLERS

(75) Inventors: Matthew T. Trawicki, Franklin, WI (US); Dennis J. Flood, Milwaukee, WI (US); Robert D. Turney, Watertown, WI (US); Michael H. Zamalis, York, PA (US)

(73) Assignee: JOHNSON CONTROLS TECHNOLOGY COMPANY, Holland, MI (US)

( * ) Notice: Subject to any disclaimer, the term of this patent is extended or adjusted under 35 U.S.C. 154(b) by 453 days.

(21) Appl. No.: 13/558,165

(22) Filed: Jul. 25, 2012

(65) Prior Publication Data

US 2014/0026598 A1 Jan. 30, 2014

(51) Int. Cl.
*F25B 49/00* (2006.01)

(52) U.S. Cl.
CPC ..... *F25B 49/00* (2013.01)

(58) Field of Classification Search
CPC ..... F25B 49/00
USPC ..... 62/125, 126, 127, 185, 201; 700/276
See application file for complete search history.

(56) References Cited

U.S. PATENT DOCUMENTS

| | | | | |
|---|---|---|---|---|
| 4,627,788 | A | 12/1986 | Keyes et al. | |
| 4,640,665 | A | 2/1987 | Staroselsky et al. | |
| 4,831,535 | A | 5/1989 | Blotenberg | |
| 4,949,276 | A | 8/1990 | Staroselsky et al. | |
| 5,355,691 | A | 10/1994 | Sullivan et al. | |
| 5,553,997 | A | 9/1996 | Goshaw et al. | |
| 5,798,941 | A | 8/1998 | McLeister | |
| 7,025,558 | B2 | 4/2006 | Blotenberg | |
| 7,824,148 | B2 | 11/2010 | Tetu et al. | |
| 2009/0198432 | A1 * | 8/2009 | Tabata et al. | 701/103 |
| 2010/0263391 | A1 | 10/2010 | Tetu et al. | |
| 2011/0093133 | A1 * | 4/2011 | Turney et al. | 700/300 |

FOREIGN PATENT DOCUMENTS

| | | | |
|---|---|---|---|
| JP | 01-129397 | A | 5/1989 |
| JP | 06-288390 | A | 10/1994 |
| JP | 08-014191 | A | 1/1996 |
| JP | 2007-509268 | A | 4/2007 |
| JP | 2007-212040 | A | 8/2007 |
| WO | WO 2009/058975 | A1 | 5/2009 |

OTHER PUBLICATIONS

York by Johnson Controls, Optiview Control Center Overview, Surge Map Screen—Table View (Software version C.OPT.01.19.307 and later), Jul. 15, 2008, 1 page.

* cited by examiner

*Primary Examiner* — Marc Norman
(74) *Attorney, Agent, or Firm* — Foley & Lardner LLP

(57) ABSTRACT

A controller for a chiller includes processing electronics configured to detect a plurality of surge events. The processing electronics create a surge map by calculating and plotting a point for each detected surge event in an at least two dimensional coordinate system. The surge map is displayed through the use of an electronic display system. The surge map describes at least three conditions of the chiller when the surge event was detected through the use of axis and non-axis representations. The processing electronics are further configured to control at least one setpoint for the chiller using the calculated surge map.

16 Claims, 17 Drawing Sheets

METHODS AND CONTROLLERS FOR PROVIDING A SURGE MAP FOR THE MONITORING AND CONTROL OF CHILLERS

BACKGROUND

The present invention relates generally to systems and methods for controlling chillers of chilled fluid systems.

A chiller controller typically uses one or more chiller control variables to control the operation of a chiller. These variables can be controlled to reduce the power consumed by the chiller, but such control can also cause a surge condition. It is challenging and difficult to develop systems and methods for controlling chillers for energy efficiency and to avoid surge conditions.

SUMMARY

One embodiment of the invention relates to a computerized method for controlling a chiller. The method includes using processing electronics of a controller for the chiller to detect a plurality of chiller surge events. The method further includes using the processing electronics to create a surge map by calculating and plotting a point for each detected surge event in an at least two dimensional coordinate system that describes conditions of the chiller associated with the detected surge event. Two of the chiller conditions are described by two distinct axes and a third chiller condition be described by a non-axis representation. The method includes causing an electronic display system to display the surge map.

In some embodiments, the method may further provide that color be used as the non-axis representation. The method may include using the processing electronics to control at least one setpoint for the chiller using the plotted surge map. In some embodiments, the method may include using the processing electronics to receive user input signals from a user input device. In this embodiment, the user input signals are used to manipulate a surge map. The method may also include causing the electronic display system to magnify portions of the map, move horizontally or vertically along the map, or display conditions associated with a chiller surge event based on user manipulation. The method may also include representing the surge points on an at least two dimensional coordinate system with grid lines forming separate and discrete positions for each point.

Another embodiment of the invention relates to a method of controlling a chiller. The method includes maintaining a surge map in memory. Maintaining the surge map includes plotting the surge map and updating the surge map using measured data from the chiller. The method also includes calculating or obtaining a current state for the chiller. The method further includes predicting a surge condition based on the current state and the surge map. The method yet further includes implementing a control measure estimated to avoid the predicted surge condition.

Another embodiment of the invention relates to a controller for a chiller. The controller includes processing electronics configured to receive information regarding a plurality of surge events and to create a surge map by calculating and plotting a point for each surge event in an at least two dimensional coordinate system. The processing electronics are further configured to describe two conditions of the chiller associated with the detected surge event in the at least two dimensional coordinate system by two distinct axes. The processing electronics are also configured to describe a third condition of the chiller associated with the detected surge event in the at least two dimensional coordinate system by a non-axis representation. In some embodiments, the non-axis representation is color. The processing electronics are further configured to cause an electronic display system to display the surge map.

Another embodiment of the invention relates to a controller for a chiller. In this embodiment, the processing electronics are configured to control at least one setpoint for the chiller using the plotted surge map. The surge map results may be calculated and stored in a table, matrix, mark-up language, or another data structure for describing points, surfaces, or objects in an at least two dimensional coordinate system. In some embodiments, the processing electronics are configured to receive user input signals form a user input device and the user input signals are used to manipulate a graphical representation of the at least two dimensional coordinate system and the surge map. In some embodiments, the user signals are used to magnify portions of the surge map or move horizontally or vertically within the surge map and to display the result on the electronic display system.

Another embodiment of the invention relates to a controller for a chiller. The controller includes processing electronics configured to display a surge map in an at least two dimensional coordinate system. The at least two dimensional coordinate system may have an axis or non-axis representation of chiller differential pressure, compressor prerotation vane position, or compressor motor variable speed drive frequency. The processing electronics may be configured to dynamically update the surge map as compressor surges occur. The processing electronics may be configured to cause a the surge map to be displayed using historical surge points.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Referring generally to the Figures, methods and controllers for providing computerized plotting and use of a two dimensional surge map having a non-axis representation (e.g., varying plot color, varying plot size, etc.) illustrating a third chiller condition are shown and described. The plots can be shown within a grid and user input (e.g., touch screen inputs, mouse inputs, etc.) can be used to zoom into or out of different graphical regions of the surge map. Outliers can be detected visually or automatically and edited, removed, or investigated.

Figure 1:
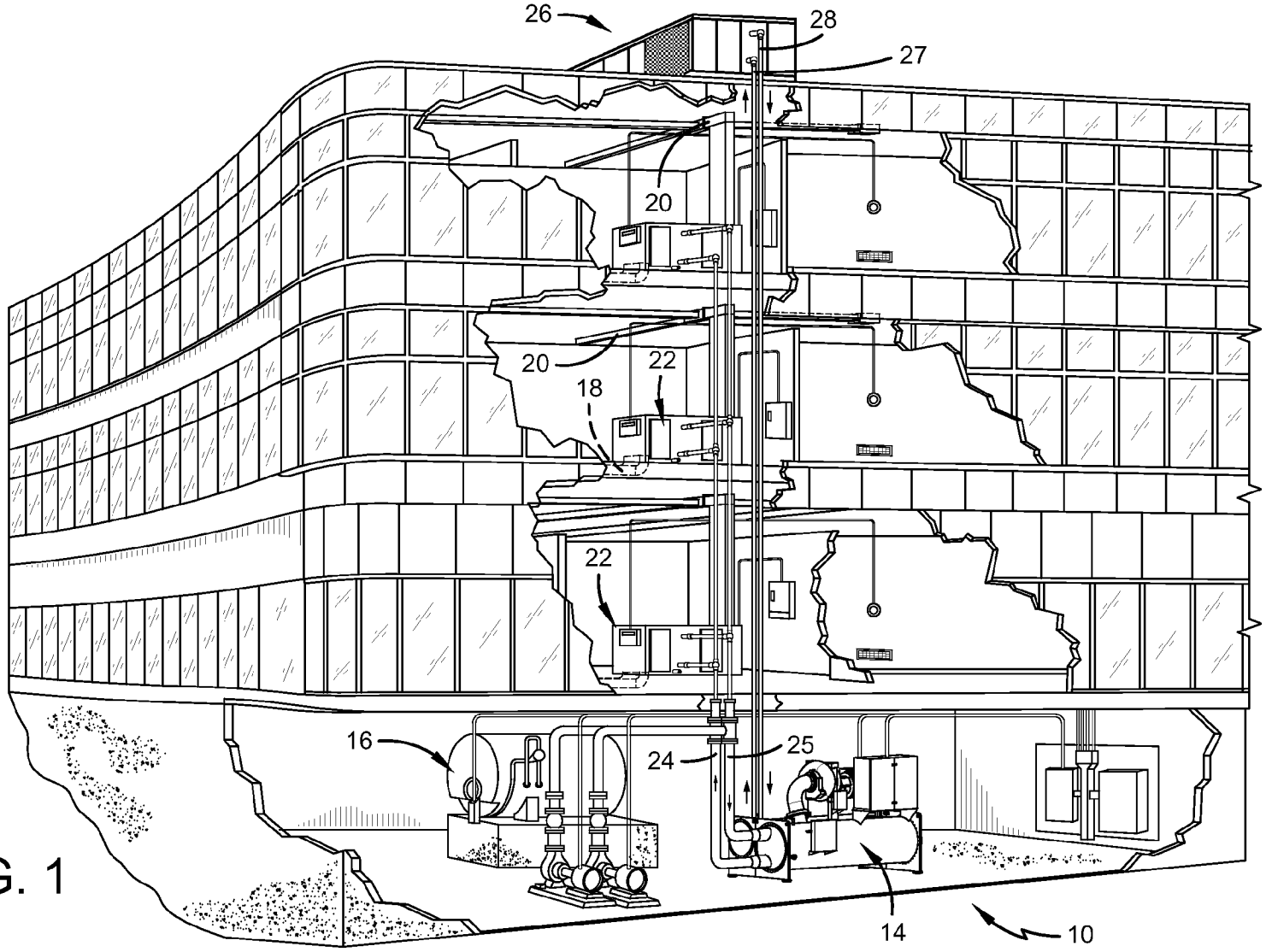
FIG. 1 is a perspective view of a building with a building management system (BMS), according to an exemplary embodiment.

Referring to FIG. 1, a perspective view of a building 10 is shown. The illustration of building 10 includes a cutaway view of an exemplary building management system that includes a heating, ventilation, and air conditioning system (HVAC) system.

One type of HVAC system uses a chilled fluid to remove heat from a building and is typically referred to as a chilled fluid system. In this type of system, a chilled fluid is used to remove heat from a building 10. The chilled fluid is placed in a heat exchange relationship with the cooling load from the building, usually warm air, via a plurality of air handling units 22. During the heat exchange with the cooling load in air handling units 22, the chilled fluid receives heat from the load (i.e., the warm air) and increases in temperature. The chilled fluid thereby removes heat from the load (e.g., warm air passing over piping in fan coil units, air handling units, or other air conditioning terminal units through which the chilled fluid flows). The resulting changed load (e.g., cooler air) is provided from air handling units 22 to building 10 via an air distribution system including air supply ducts 20 and air return ducts 18.

The HVAC system shown in FIG. 1 includes a separate air handling unit 22 on each floor of building 10, but components such as air handling unit 22 or ducts 20 may be shared between or among multiple floors. Boiler 16 can add heat to the air passing through air handling units 22 when conditions exist to warrant heating.

The chilled fluid is no longer chilled after receiving heat from the load in air handling units 22. To re-chill the fluid for recirculation back to the air-handling units, the fluid is returned to chiller 14 via piping 25.

In the embodiment of FIG. 1, water (or yet another chilled fluid) flows through tubes in the condenser of the chiller 14 to absorb heat from the refrigerant vapor and causes the chiller's refrigerant to condense. The water flowing through tubes in the condenser is pumped from the chiller 14 to a cooling tower 26 via piping 27. The cooling tower 26 utilizes fan driven cooling of the water or fan driven evaporation of the water to remove heat from the water delivered to cooling tower 26 via piping 27. The water cooled by cooling tower 26 is provided back to chiller 14's condenser via piping 28.

Figure 2:
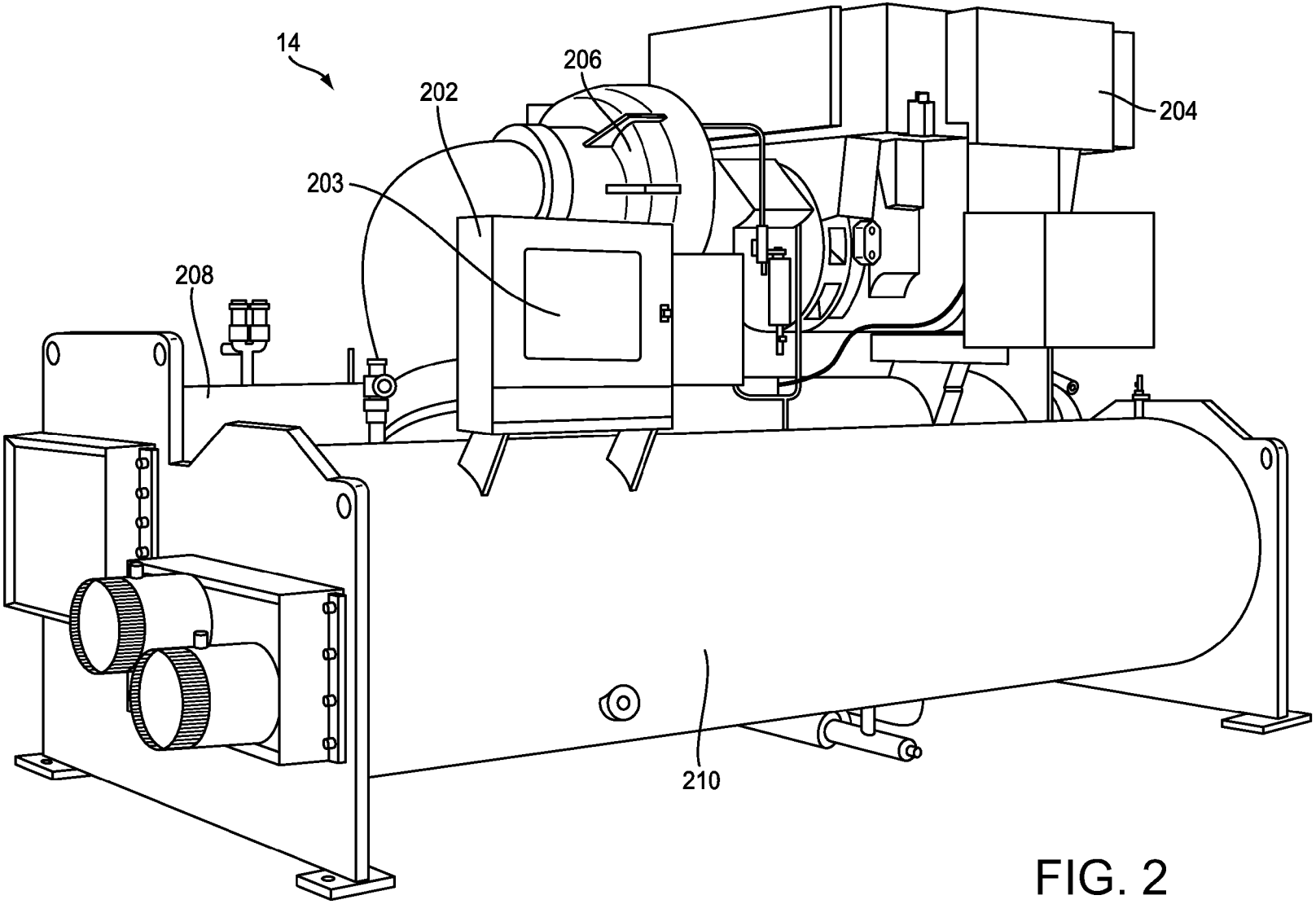
FIG. 2 is an illustration of an exemplary chiller, according to an exemplary embodiment.
Figure 3:
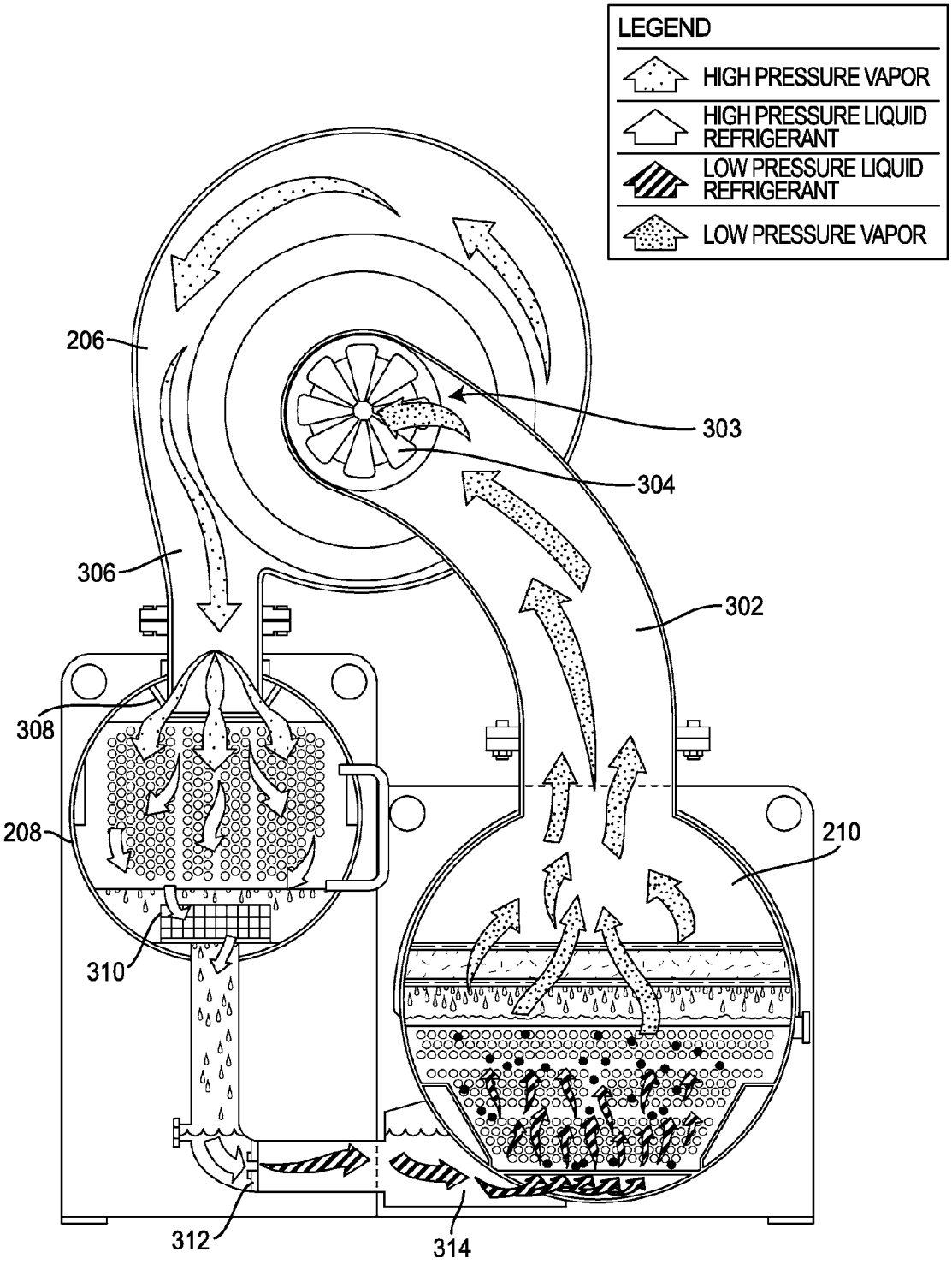
FIG. 3 is a simplified cut-away diagram of the chiller of FIG. 2 and its operation, according to an exemplary embodiment.

A chiller and its operation are illustrated in FIGS. 2-3, according to an exemplary embodiment. Chiller 14 is shown to include evaporator 210, which provides a heat exchange between the fluid returned from the HVAC system and another fluid, such as a refrigerant. The refrigerant in evaporator 210 of chiller 14 removes heat from the chilled fluid during the evaporation process, thereby cooling the chilled fluid. The refrigerant absorbs heat from the chilled fluid and changes from a boiling liquid and vapor state to vapor inside evaporator 210. The chilled fluid is then circulated back to the air handling units 22 via piping 24, as illustrated in FIG. 1, for subsequent heat exchange with the load.

Suction at portion 302 causes the refrigerant vapor to flow into compressor 206 of chiller 14 where compressor 206 has a rotating impeller 303 (or another compressor mechanism such as a screw compressor, scroll compressor, reciprocating compressor, centrifugal compressor, etc.) that increases the pressure and temperature of the refrigerant vapor and discharges it into condenser 208. The impeller 303 is driven by motor 204, which may have a variable speed drive (e.g., variable frequency drive). The impeller 303 may further include or be coupled to an actuator that controls the position of prerotation vanes 304 at the entrance to the impeller of compressor 206.

Discharge at portion 306 from compressor 206 passes through discharge baffle 308 into condenser 208 and through sub-cooler 310, controllably reducing the discharge back into a liquid form. The liquid then passes through flow control orifice 312 and through oil cooler 314 to return to evaporator 210 to complete the cycle.

In the embodiment shown in FIG. 2, chiller 14 includes a controller 202 coupled to an electronic display 203 such as a touch screen. The controller 202 and the electronic display 203 may be used for monitoring the performance of the chiller 14 or for adjusting settings of the chiller 14 (e.g., via touch screen inputs, via button inputs, etc.).

Controller 202 has a processing circuit configured to adjust components of the chiller to meet, for example, pressure and temperature setpoints for the chilled fluid or refrigerant systems. For example, as a building's heating load changes, chiller components such as prerotation vanes 304 and the variable speed drive of motor 204 may be adjusted to hold the building's temperature constant. If the building's heating load decreases (e.g., the building cools) and/or a desired temperature setpoint for the building increases (e.g., the building occupants are calling for less cooling), the variable speed drive is slowed and/or prerotation vanes 304 are adjusted to decrease the flow of refrigerant through compressor 206.

One strategy to achieve energy efficiency in chiller 14 is to operate motor 204 of compressor 206 at low rotational speeds for the target setpoints. However, compressor 206 can become unstable if the back pressure at the compressor's outlet becomes higher than that produced (i.e., output) by compressor 206, causing the flow of refrigerant in compressor 206 to momentarily reverse, and defining an event known as a surge. Surges can cause wear and tear and in some cases immediate damage to compressor 206 and system components. Because the conditions that cause a surge vary (e.g., due to different load conditions, temperature conditions, pressure conditions, prerotation vane positions, variable speed drive frequencies, flow rates, compressor characteristics, etc.) it is difficult to predict when surges will occur if a system is being controlled for energy efficiency (e.g., running the compressor at low rotational speeds relative to setpoints, etc.).

According to various embodiments of the disclosure, chiller 14 is controlled relative to a two or three dimensional set of chiller conditions. The graphical representation of surges on the at least two dimensional coordinate system may be referred to as a "surge map." In an exemplary embodiment, chiller conditions that resulted in a surge are shown on a two-dimensional map of information where two chiller conditions are represented by axis location and a third chiller condition is represented, on the surge map, via a non-axis representation (e.g., plot color, plot size, etc.). Points on the surge map can serve to create thresholds between normal operational states and states in which a surge event may exist or may be caused to exist. The surge map may be constructed using the axes of: (1) prerotation vane position (PRV) or variable geometry diffuser (VGD) position, and (2) differential pressure (DPP) (which may be computed by [(condenser pressure−evaporator pressure)/evaporator pressure]). A third chiller condition, variable speed drive (VSD) speed (e.g., frequency), may be represented on the surge map by a color gradient. In alternative embodiments, VSD may be shown on one of the axes and PRV/VGD and DPP may be variously shown on the remaining axis and via the non-axis representation.

While many of the examples shown and described herein illustrate and discuss PRV, DPP, and VSD speed, in other embodiments and examples other chiller parameters may be identified, detected, calculated, stored, or otherwise used in the surge map display, control, or activities of the present disclosure. For example, in some embodiments, an electronically controlled expansion valve of the chiller can be controllably adjusted and its position may be tracked as one of the parameters in the coordinate system that describes surge events. In the same or other embodiments, a hot gas bypass valve configured to bleed pressure around the compressor can be controllably adjusted and its position may be tracked as one of the parameters in the coordinate system that describes the chiller's condition during surge events. In the same or yet other embodiments, a variable geometry diffuser may act on the output of the compressor and can be controllably adjusted. The variable geometry diffuser's setting or position may be tracked as one of the parameters in the coordinate system that describes the chiller's condition during surge events. Any combination of the above manipulated variables of the chiller may be tracked, detected, identified, calculated, or otherwise used to generate, update, and/or use the surge maps and related control structures and activities as described herein. For example, a surge map may be constructed as described herein with expansion valve position and VSD frequency as the axes, and VGD position represented by a color gradient, in some exemplary embodiments.

Coordinates in the system associated with surge events occur and can then be recorded. In other words, as surge events are detected, the chiller conditions at the time of the surge event are recorded and stored as a surge point in the surge map coordinate system. The chiller's controller can use the formed surge map as a guide to separate normal operational states for chiller 14 and states in which a surge condition may exist. In this way, chiller 14 can be controlled for energy efficiency by operating the chiller at a minimum variable speed drive frequency (i.e., speed), while avoiding potentially damaging surge events. By controlling the chiller relative to at least three chiller conditions rather than a simple threshold or thresholds, it may be possible to achieve greater energy efficiencies than systems using the simple threshold calculations.

Figure 4:
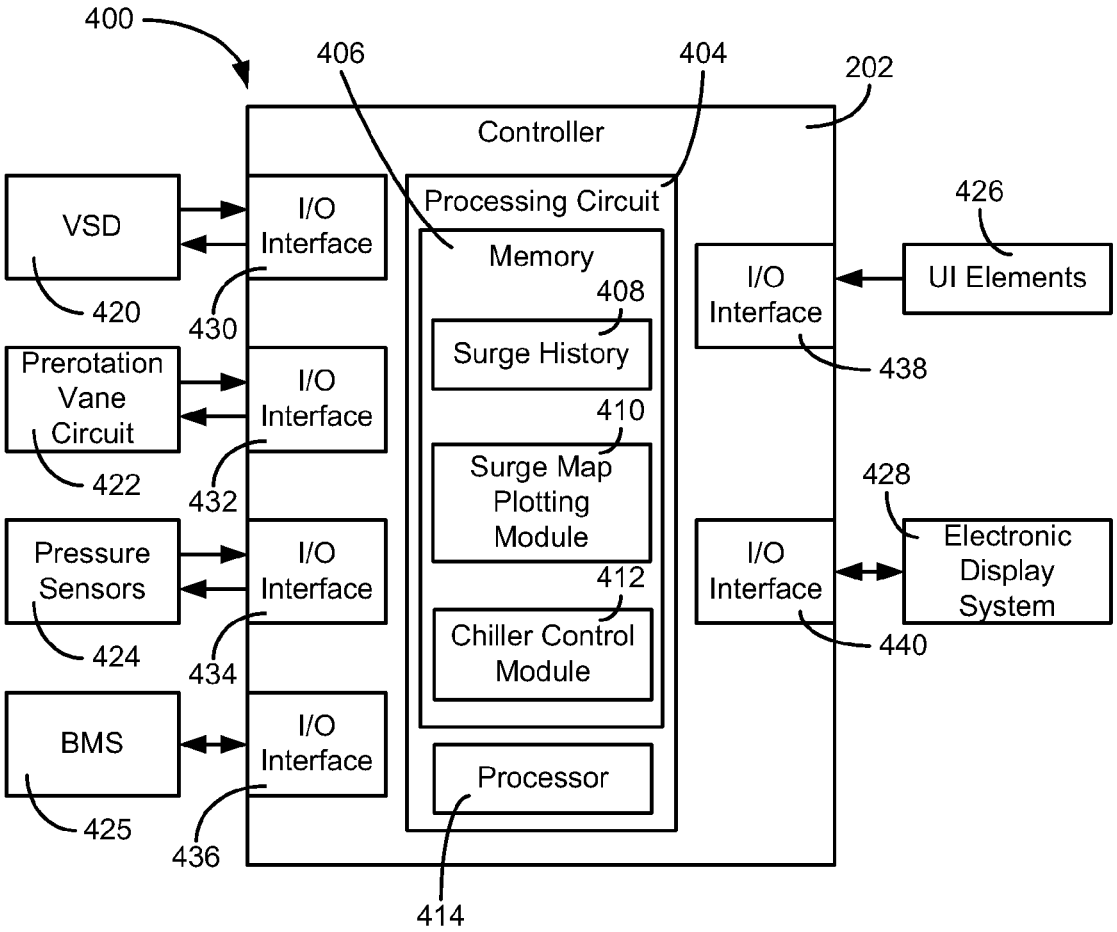
FIG. 4 is a block diagram of a chiller controller, according to an exemplary embodiment.

FIG. 4 illustrates an exemplary block diagram of a system 400 for controlling a chiller, according to an exemplary embodiment. Controller 202 is configured to detect and log (i.e., store) surge events in memory 406 generally, and in surge history 408 more particularly. Controller 202 calculates parameters and corresponding surge points for each detected surge event to describe at least three conditions of the chiller when the surge event was detected. Controller 202 then uses a surge map plotting module 410 to construct a surge map using the calculated surge points. Controller 202 adjusts and controls at least one setpoint for the chiller (e.g., prerotation vane position, variable speed drive speed, etc.) based on the plotted surge map.

System 400 is shown to include a variable speed drive (VSD) 420, a prerotation vane circuit 422, pressure sensors 424, and a building management system (BMS) 425. Controller 202 is shown as coupled to UI elements 426 (e.g., mouse, keyboard, touch screen areas) and an electronic display system 428 (e.g., LCD, CRT, touchscreen display, etc.). Controller 202 also includes a number of input and output (I/O) interfaces 430, 432, 434, 436, 438 and 440 for providing information to or for receiving information from connected devices or systems. The I/O interfaces 430, 432, 434, 436, 438 and 440 may be or include jacks or terminals of varying types and may include circuitry for filtering or otherwise transforming information passing through the I/O interfaces. The I/O interfaces 430, 432, 434, 436, 438, and 440 may be configured to communicate via similar or different protocols.

Referring still to FIG. 4, controller 202 includes a processing circuit 404 (e.g., "processing electronics"). Processing circuit 404 is shown to include memory 406 and a processor 414. Processor 414 may be a general purpose processor, an ASIC, or another suitable processor configured to execute computer code or instructions stored in memory 406. Memory 406 may be hard disk memory, flash memory, network storage, RAM, ROM, a combination of computer-readable media, or any other suitable memory for storing software objects and/or computer instructions. When processor 414 executes instructions stored in memory 406 for completing the various activities described herein, processor 414 generally configures controller 202 and more particularly processing circuit 404 to complete such activities. Said another way, processor 414 is configured to execute computer code stored in memory 406 to complete and facilitate the activities described herein.

In an exemplary embodiment, processing circuit 404 is configured to detect a plurality of surge events (e.g., using pressure inputs from pressure sensors 424) and to calculate a surge point for each detected surge event in a coordinate system that describes at least three conditions of the chiller when the surge event was detected (i.e., conditions of the chiller associated with the surge event). Processing circuit 404 is further configured to use the calculated surge points and to control at least one setpoint for the chiller using the plotted surge map.

Memory 406 is shown to include surge history 408, surge map plotting module 410, and chiller control module 412. Surge history 408 may be an array, relational database, table, linked list or other data structure configured to store information regarding surges. Surge map plotting module 410 may be a computer code module (e.g., function, class, object, code section, combination thereof, etc.) configured to use surge history 408 to construct a surge map based on the history. Chiller control module 412 may include computer code or hardware circuitry configured to control one or more chiller control variables (e.g., a VSD speed setting, a prerotation vane position, a pressure target, etc.) using the surge map plotted by surge map plotting module 410. Chiller control module 412 also uses setpoint information (e.g., target chilled fluid temperature, chiller demand signals, etc.) to conduct its control of the one or more chiller control variables. For example, in some embodiments, chiller control module 412 attempts to drive VSD power as low as possible while attaining a received chilled fluid setpoint demanded by a BMS (e.g., an HVAC supervisory controller of the BMS). Because multiple chiller control variables (e.g., three) can be adjusted while the chiller control module seeks energy efficiency and setpoint performance targets, the chiller control module 412 can use the parameters displayed on the surge map to constrain its behavior (e.g., prevent the VSD speed setting from dropping such that a surge is experienced). Chiller control module 412 can also use the surge map to seek greater energy efficiency while attaining the target chilled fluid setpoint. For example, the chiller control module 412 may be able to find combinations of three chiller control variables that result in lower energy expenditure while attaining or maintaining the target chilled fluid setpoint (e.g., finding prerotation vane positions and differential pressure positions that allow VSD frequency to be reduced).

While processing circuit 404 is shown to include particular modules for completing activities of the present disclosure, it should be noted that processing circuit 404 may include other modules or that an activity described with respect to one module (e.g., surge map plotting module 410) may be completed by another module or by a combination of modules. Further, in some embodiments, "processing circuit" or "processing electronics" as used in the present disclosure can extend to distributed processing systems wherein one or more of the processing activities are completed by a different processor or system (e.g., a computer module of the BMS).

Figure 5:
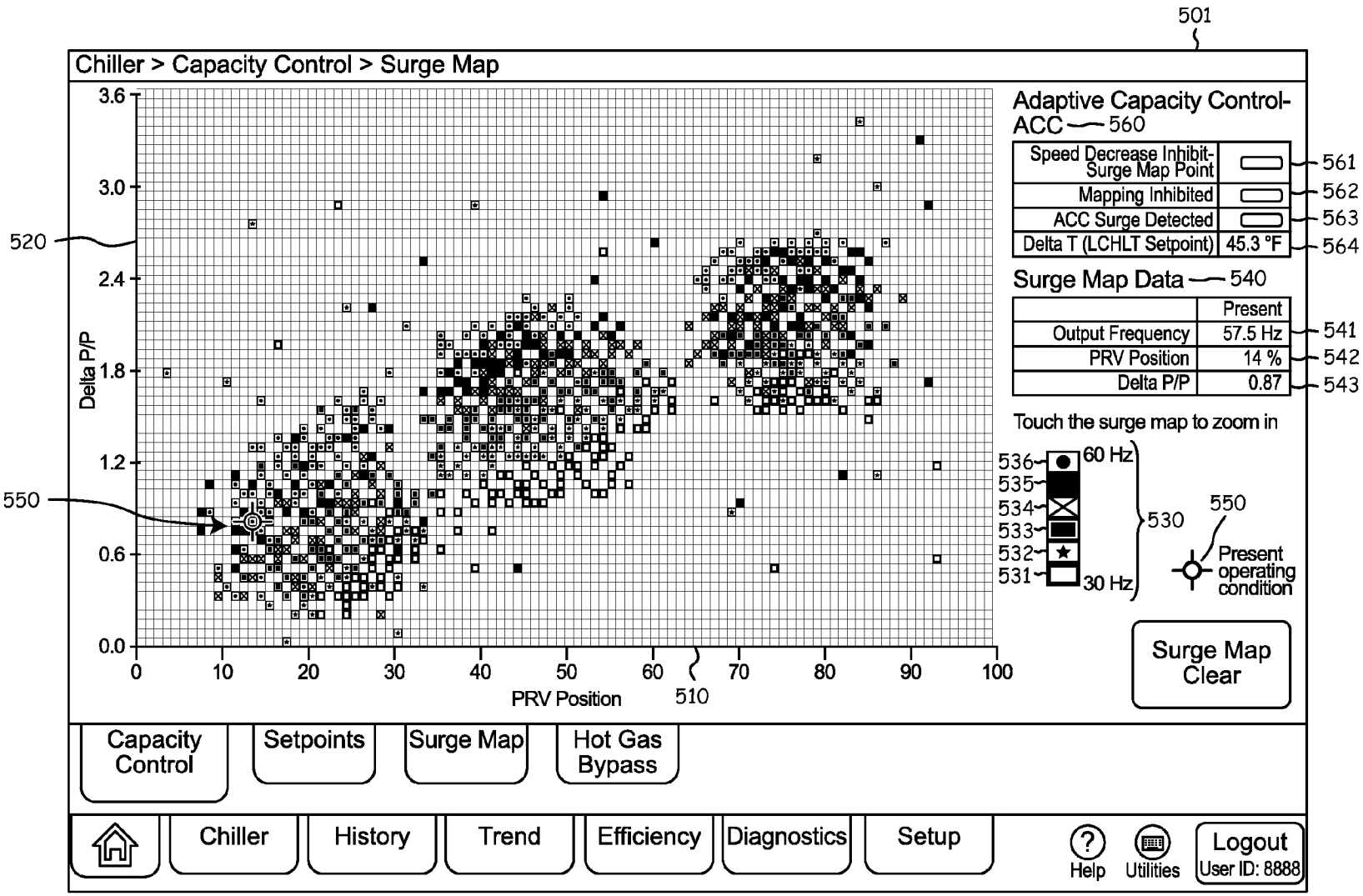
FIG. 5 is a graphical representation of a surge map, according to an exemplary embodiment.

Referring now to FIG. 5, a graphical representation of a surge map that may be plotted by the systems and methods of the present disclosure is shown. The surge map is shown in FIG. 5 as part of the surge map display 501 that is presented to the chiller operator. The surge map is plotted in a two dimensional coordinate system with axes 510 and 520 each representing a surge event condition. Through the use of a color key 530, color represents a third surge event condition on the surge map. Therefore, a surge point on the surge map describes at least three conditions of the chiller that existed when a surge event was detected. For example, the axes 510 and 520 may represent prerotation vane position and differential pressure, respectively, and a color key 530 may represent VSD frequency.

An initial surge map may be created by using characteristics of the chiller system (e.g., evaporator size, condenser size, compressor properties, etc.). The initial surge map may also be created by purposefully operating the chiller until surge events are caused and mapping the surge points based on actual conditions that provide a surge. In yet other embodiments, the controller does not include an initial surge map and one is created dynamically as surges naturally occur. In any of the above embodiments, however, the surge map is dynamically updated and maintained as surge events occur and as the chiller is operated.

As surge events occur and the surge map is populated, a color gradient is developed. In the preferred embodiment, VSD frequency (Hz) is represented by a color key 530. In this embodiment, surge events that occur when the chiller is operating at the lowest allowable VSD frequency (30 Hz) are represented by a dark green 531 color. As the chiller VSD frequency increases, the surge points change in color from dark green 531, to light green 532, to yellow 533, to orange 534, to light brown 535, and then to red 536 when the chiller is operating at the highest allowable VSD frequency (60 Hz). This color scheme is preferred because it utilizes colors that are differentiated by a chiller operator with a color vision deficiency. In some embodiments, colors are used to represent other chiller conditions, such as prerotation vane position, differential pressure, or other conditions associated with the chiller surge event. In other embodiments, a chiller condition can be represented by another type of color scheme, or a single color with different levels of shading. In some embodiments, VSD frequency and therefore the surge map representation of frequency is based on the power line frequency. Accordingly, a 30-60 Hz range of VSD frequency may be used for 60 Hz power (as illustrated) while 50 Hz power may result in a 25-50 Hz range for the VSD (e.g. colors of dark green may be used to represent a 25 Hz speed and red color may be used to represent a 50 Hz speed).

Surge map resolution may vary according to varying embodiments or the graphical resolution of a grid within which the surge map is plotted. Resolution may be adjusted on one axis or another to provide for a more pleasing or sensible visual surge map graphical representation. For example, differential pressure axis 520 (or another axis or color gradient) may be configured at a relatively high resolution to achieve a certain spread of surge map plots (e.g., as shown in FIG. 5). According to an exemplary embodiment, a controller configured to provide energy optimizing control algorithms by reducing the VSD speed to the lowest operating value possible repeatedly attempts to run VSD to a lower frequency while avoiding a known (e.g., plotted) surge condition.

The surge map display 501 includes a surge map data table 540 illustrating data representing the present operating conditions of the chiller (whether surging or not). In the embodiment shown in FIG. 5, the surge map data table 540 includes output frequency 541, PRV position 542, and differential pressure 543. Surge map data table 540 can be configured to display other chiller operating conditions. For example, rather than displaying the present operating condition, the system may be configured to illustrate the conditions associated with the last detected surge or a user selected surge point. The present operating condition is represented on the surge map by a sight symbol 550. While sight symbol 550 is shown in FIG. 5 as an open-crosshair symbol, in varying embodiments other symbols may be used (e.g., a box, an arrow, a pointer, etc.).

In varying exemplary embodiments, the trajectory of the present operating condition may be calculated by the chiller controller. Using such a calculation, the chiller controller can begin slowing down an approach to a historical surge point or backing away from the historical surge point (e.g., points on the map) to avoid surges. In an exemplary embodiment, the chiller controller calculates or determines a current state of the chiller and predicts whether a surge condition will occur based on at least the present operating condition relative to the historical surge points on the surge map. In varying exemplary embodiments, the controller can use a surge history to determine whether an operating trend exists that indicates a surge condition will be reached. If a surge is predicted by the chiller controller, the chiller controller can implement a control measure estimated to avoid the predicted surge condition. Prediction of future surges based on historical and current operating conditions can be calculated by applying a Kalman estimator to the surge history and new operating conditions.

The surge map display 501 is shown to include adaptive capacity control 560 portion. Adaptive capacity control 560 portion may include a plurality of indicators or controls. In the illustrated embodiment, a rectangular-shaped indicator to the right of a text description illustrates the enabled or disabled state of the described option. If the user touches or otherwise selects the indicator, the system can change states in response to such touch or selection. Accordingly, by interacting with adaptive capacity control ACC portion 560, the user can cause the controller to change the operation of the controller or chiller.

Speed decrease inhibit option 561 can prevent the chiller from reducing its speed in the event that the present operating condition is nearing a surge point on the surge map. Mapping inhibit option 562 can run the chiller without plotting surge events on the surge map. ACC surge detected 563 is an indicator for the operator that a surge event has been detected (e.g., within the last X minutes or seconds). Delta T 564 displays the leaving chilled liquid temperature (LCHLT) setpoint (e.g., which may change due to user selection, an algorithm, or commands from a supervisory controller which gauges demand of the overall cooling system).

Figure 6A:
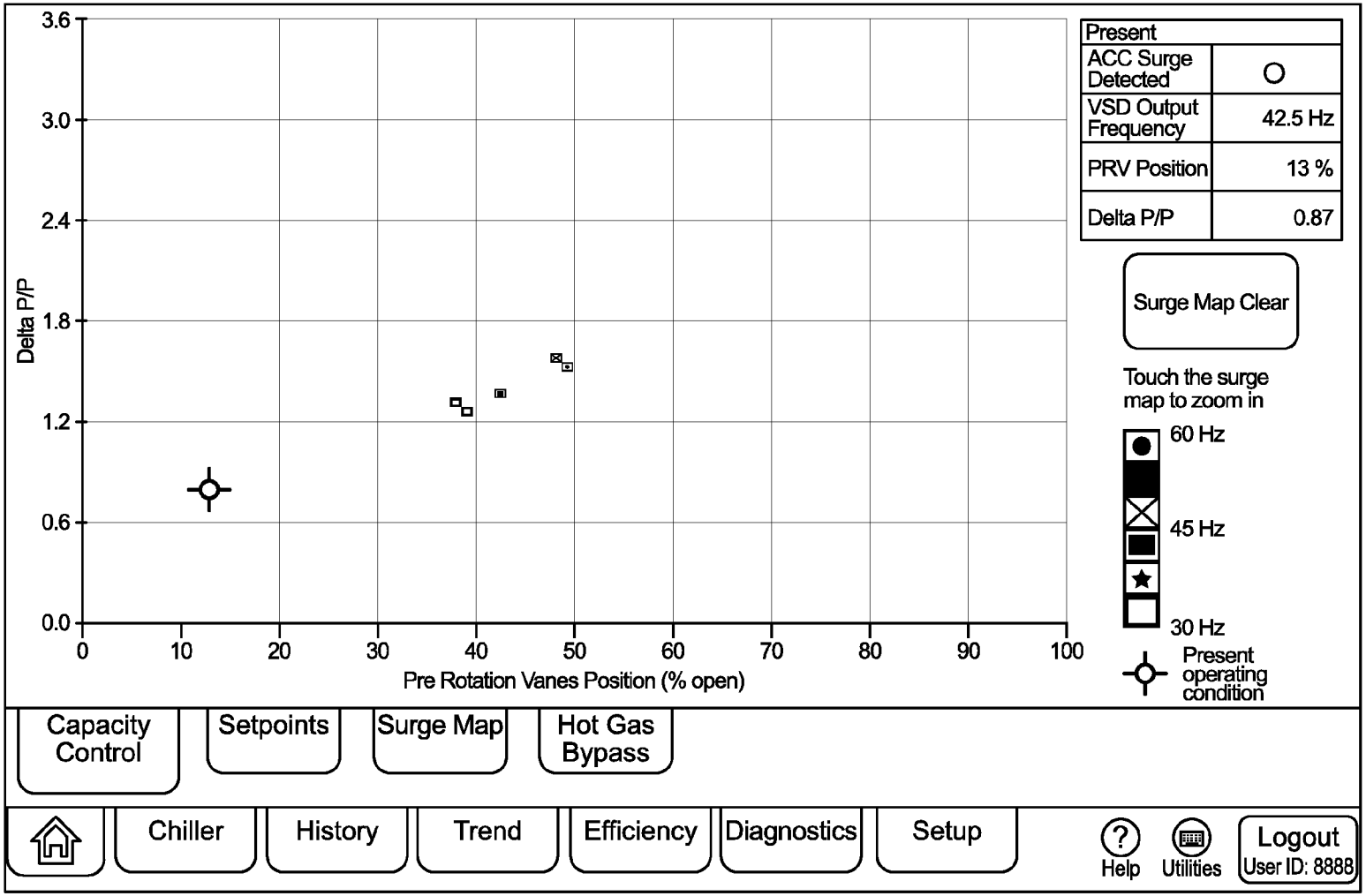
FIG. 6A is a graphical representation of a surge map with isolated surge points, according to an exemplary embodiment.

Referring now to FIG. 6A, a graphical representation of a surge map that may be plotted by the systems and methods of the present disclosure is shown. In this embodiment, a small number of surge points are isolated for view. By touching the surge map on the electronic display 203, an operator can cause the surge map display 501 to display a magnified portion of the map. In addition, the operator can select a particular surge point by touching that surge point on the electronic display 203. The operator can then view conditions related to the associated chiller surge event, such as PRV position, differential pressure, and VSD frequency.

Figure 6B:
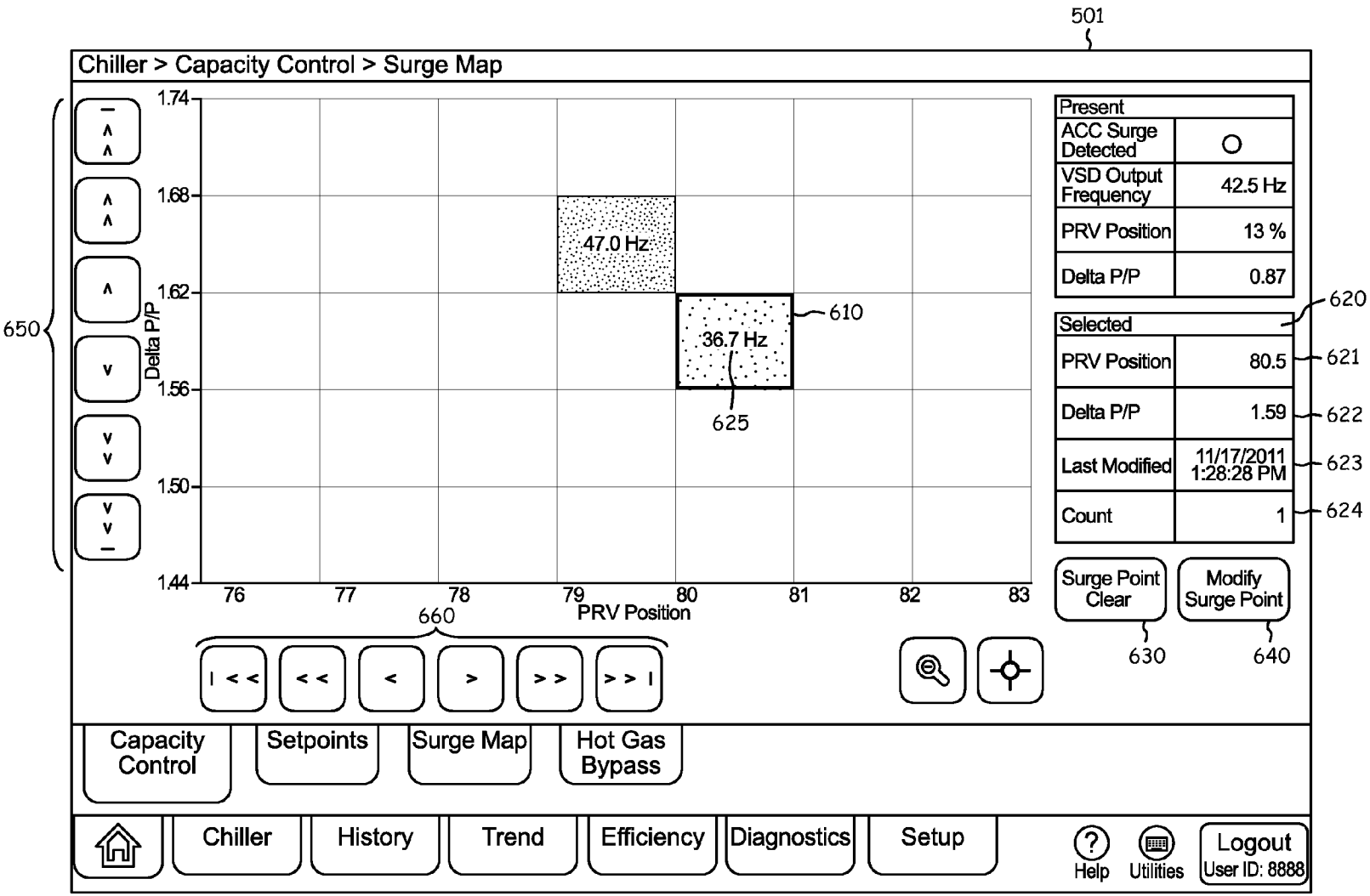
FIG. 6B illustrates the zoom capability of a surge map, according to an exemplary embodiment.

Referring now to FIG. 6B, a graphical representation of a surge map that may be plotted by the systems and methods of the present disclosure is shown. The surge map view shown is seen by utilizing the zoom function on surge map display 501. The zoomed-in view of FIG. 6B may show a further level of zoom relative to the zoomed-in view of FIG. 6A. The operator may zoom in on a particular surge point 610 and its surrounding surge points by touching the surge point on electronic display 203 on a zoomed-out view. Once selected, PRV position 621, differential pressure 622, last modification 623, and count 624 are displayed for selected surge point 610 on surge point data table 620. VSD frequency (Hz) 625 is displayed on surge point 610 itself.

The operator is able to clear or modify a selected surge point data by touching surge point clear 630 or modify surge point 640, respectively, on surge map display 501. When a user touches modify surge point 640, the user may then be able to touch and drag the surge point to a new coordinate, gesture to change the color (i.e., VSD speed), or may cause the controller to present the user with a pop-up window or other user interface tool for modifying the selected surge point. Modifying the surge point can also include deleting the surge point. By visually inspecting the surge maps of FIGS. 5 and 6A, the user may be able to bring outlier surge points into an area more likely to be associated with actual surge conditions. Further, by visually inspecting the surge maps of FIGS. 5 and 6A, a user may be able to delete surge points that look like outliers. Deletion or modification of outlier surge points may allow the system to "retry" or "retest" varying condition combinations for whether a surge will occur and may allow the system to find improved operating efficiency than a system wherein historical surges constantly "push up" the VSD floor. It should be noted that in a preferred embodiment editing (e.g., adding, modifying, deleting, etc.) the points on the surge map causes the controller to edit the live surge history data used for control of the chiller (e.g., used for seeking energy efficient chiller operating condition combinations). Vertical arrows 650 and horizontal arrows 660 allow the operator to scroll on the screen to see chiller conditions related to other surge points.

Figure 7:
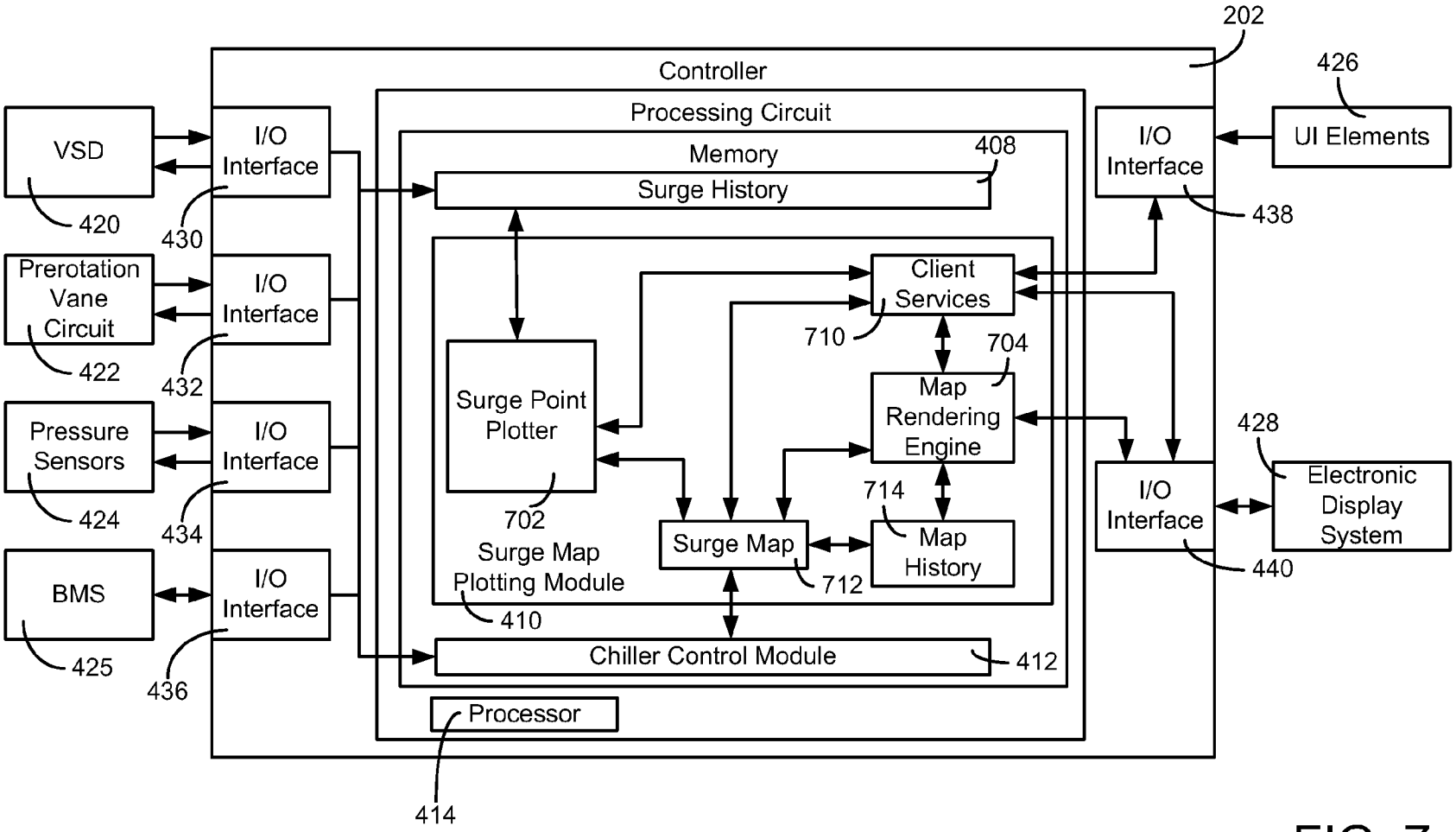
FIG. 7 is a detailed diagram of a chiller surge map plotting module, according to an exemplary embodiment.

Referring now to FIG. 7, surge map plotting module 410 of FIG. 4 is shown, according to an exemplary embodiment. Surge map plotting module 410 receives historical data of detected surge events from surge history 408. The historical data may be previously plotted coordinates. In another embodiment, the historical data may include raw measurements taken during a surge event or just prior to a surge event and can be used to calculate one or more parameters of the surge map. Surge map plotter 702 uses the historical data to plot one or more surge maps 712. In some embodiments, surge map plotter 702 plots surge maps 712 by using estimated surge points based on certain conditions of surge events stored in surge history 408. For example, surge map plotter 702 may use curve fitting techniques or any other techniques described above to connect the surge points.

Surge map plotter 702 receives surge event data from surge history 408 and/or user parameters from client services 710 to plot a surge map 712. Surge map plotter 702 may use one of a variety of plotting technique to plot the surge points on the surge map. In one embodiment, surge map plotter 702 uses a plotting technique depending on user preferences received from client services 710. For example, a user may prefer a lower resolution control and plotting technique if the user determines that a high resolution map is resulting in too much speed-up and speed-down.

Historical surge maps may be stored in map history 714 as new maps are plotted by surge map plotter 702. In some exemplary embodiments, map history 714 is maintained for particular periods of time (e.g., seasons, months, weeks, etc.) or operating conditions (e.g., heavy utilization, occupancy, weather states, etc.). These histories may be "swapped in" for surge map 712 (e.g., when the seasons change) to more accurately control for the conditions that a chiller will be experiencing in the future. In another embodiment, map history 714 may be used to estimate potential surge events. For example, trending changes in the previous maps may be used to estimate new potential surge points.

Surge map plotting module 410 is further shown to include map rendering engine 704. Map rendering engine 704 communicates with I/O interface 440 to display surge maps on electronic display system 428. The displayed maps may be based on surge map 712 and/or map history 714. Map history 714 may be graphically represented as trail lines, a "ghost" map, different colors, via animation, or otherwise. A "ghost" map may refer to a map which displays a historical surge map as partially transparent, in broken lines, with a light color shade, or otherwise to indicate its age relative to the current map. Multiple historical surge maps from map history 714 may be shown on a single screen with the current surge map 712 to illustrate how operating conditions have changed over the past years, seasons, months, etc. In other exemplary embodiments, trends in the movement of surge map 712 may be calculated and future surge map values may be determined. Generated surge points may also be displayed using trend-based estimates for future surge parameters.

Client services 710 is shown to receive various user parameters from UI elements 426 via I/O interface 438 and from electronic display system (e.g., touch screen) 428 via I/O interface 440. For example, controller 202 may receive a manual adjustment of a surge point via client services 710. Surge map plotter 702 can use the user-specified surge points from client services 710 to plot surge map 712. Surge map plotter 702 can also utilize user parameters to select a computational technique (e.g., linear regression, linear interpolation, etc.) to estimate potential surge events. In some embodiments, (e.g., depending on user-entered settings), the system does not estimate potential surge events but only records, plots and controls using actual surge data. Map rendering engine 704 may also utilize user parameters to render surge map 712 on electronic display system 428. For example, a user may specify that a rendering of surge map 712 is to use a different color gradient on electronic display system 428. Client services 710 may include one or more web servers, server modules, client-request listeners, or other modules for serving or generating user interfaces.

Figure 8:
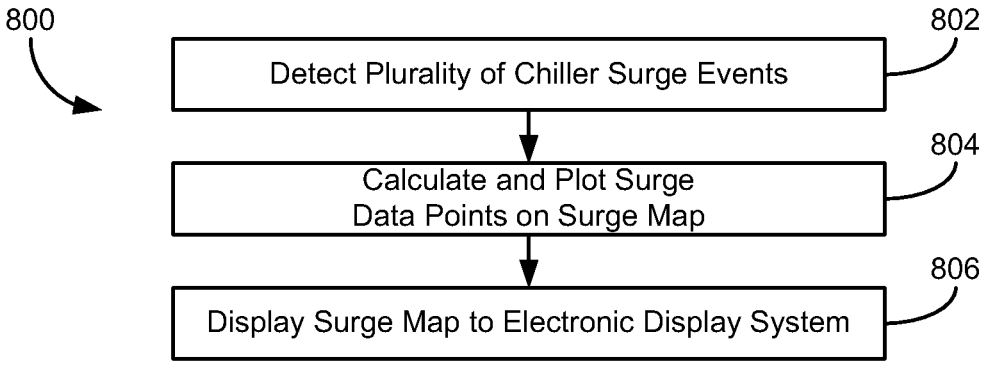
FIG. 8 is a flow chart of a process for plotting a chiller surge map, according to an exemplary embodiment.

Referring now to FIG. 8, a process 800 for plotting a surge map is shown, according to an exemplary embodiment. Process 800 includes detecting a plurality of chiller surge events (step 802). In general, a surge event in the chiller may exist if the pressure at the compressor's outlet becomes higher than that produced by the compressor. Process 800 also includes calculating and plotting surge points in two or more dimensions using surge event data (step 804). Surge event data, i.e. the operating conditions of the chiller at the time a surge event is detected in step 802, may include a position of a prerotation vane, a VSD speed, measurements from sensors, or other information relating to the operation of the chiller. A coordinate in two or more dimensions with color gradient can be formed using this data by assigning each type of data to a particular axis or color gradient. Process 800 is further shown to include displaying the surge map to electronic display system (step 806). In some embodiments the plotted points are left unconnected (lines are not drawn between points). In alternative embodiments, the surge points may be connected using a curve fitting technique such as linear interpolation or any other technique capable of connecting the surge points to form a curve of estimated surge points on the surge map.

Figure 9:
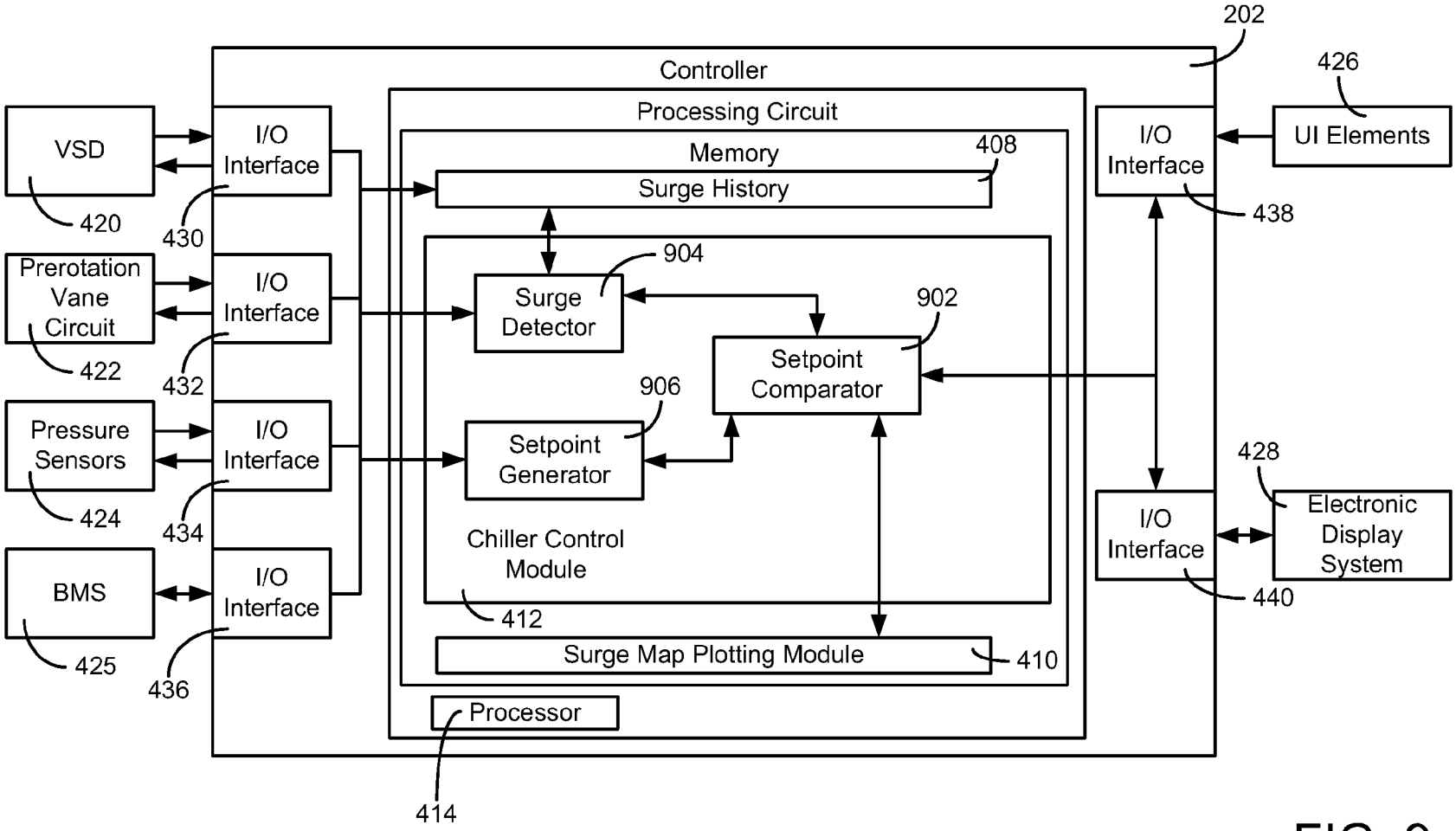
FIG. 9 is a detailed diagram of a chiller control module that makes use of varying chiller surge maps described herein, according to an exemplary embodiment.

Referring now to FIG. 9, chiller control module 412 of FIG. 4 is shown in greater detail, according to an exemplary embodiment. Chiller control module 412 is configured to monitor and control the chiller system (e.g. VSD 420, prerotation vane circuit 422, and pressure sensors 424) via interfaces 430, 432, and 434. Chiller control module 412 may also communicate with other components of BMS 425 (e.g., a supervisory controller, a Johnson Controls Metasys controller, etc.) via interface 436.

Chiller control module 412 is shown to include surge detector 904, which receives data from the chiller (e.g., from pressure sensors 424) to determine if a fault event exists. For example, a surge event may exist if data received from pressure sensors 424 indicate that the pressure at the compressor's outlet is higher than that produced by the compressor. If surge detector 904 detects a surge, data from the chiller (e.g. VSD 420, prerotation vane circuit 422, and pressure sensors 424) and/or from BMS 425 are converted into one or more parameters or conditions and stored as surge event data in surge history 408.

Chiller control module 412 is also shown to include setpoint generator 906, which generates operating setpoints for one or more components of the chiller (e.g., a particular speed setpoint for VSD 420). When viewed graphically, setpoints provide a target location for operating points in the coordinate system. Setpoint generator 906 may receive data from setpoint comparator 902 that indicates the current operating point's position relative to a surge point. If the operating point is below, at, near, or approaching a surge point, setpoint generator 906 may generate a new setpoint calculated to avoid a VSD frequency previously associated with a PRV and DP coordinate pair. Setpoint generator 906 may receives a target setpoint (e.g., Delta T and/or output pressure setpoint) from a supervisory system in BMS 425, such as a master controller. Using such a received target, setpoint generator may adjust PRV, DP, and VSD frequency in a manner expected to provide the received target setpoints. In another embodiment, setpoint generator 906 may receive a particular component setpoint or an output target from a user via UI elements 426 or electronic display system 428.

Chiller control module 412 is also shown to include setpoint comparator 902 which calculates the difference between the current operating point of the chiller and one or more surge points from surge map plotting module 410. In one embodiment, setpoint comparator 902 receives data from the chiller directly from interfaces 430, 432, and 434 to determine the current operating point. In another embodiment, the current operating point is determined by surge detector 904 and provided to setpoint comparator 902. Setpoint comparator 902 may also be configured to estimate a trajectory and motion of the operating point relative to a surge map. For example, setpoint comparator 902 may use a Kalman estimation to predict the future location and/or trajectory of the operating point. Setpoint comparator 902 may provide data to surge map plotting module 410 for use in making plots to electronic display system 428 via interface 440. Setpoint comparator 902 may also or alternatively provide the display data to map rendering engine 704 shown in FIG. 7 to display the current operating point, setpoint, and/or predicted trajectory in addition to, or in place of, the rendered surge maps.

Figure 10:
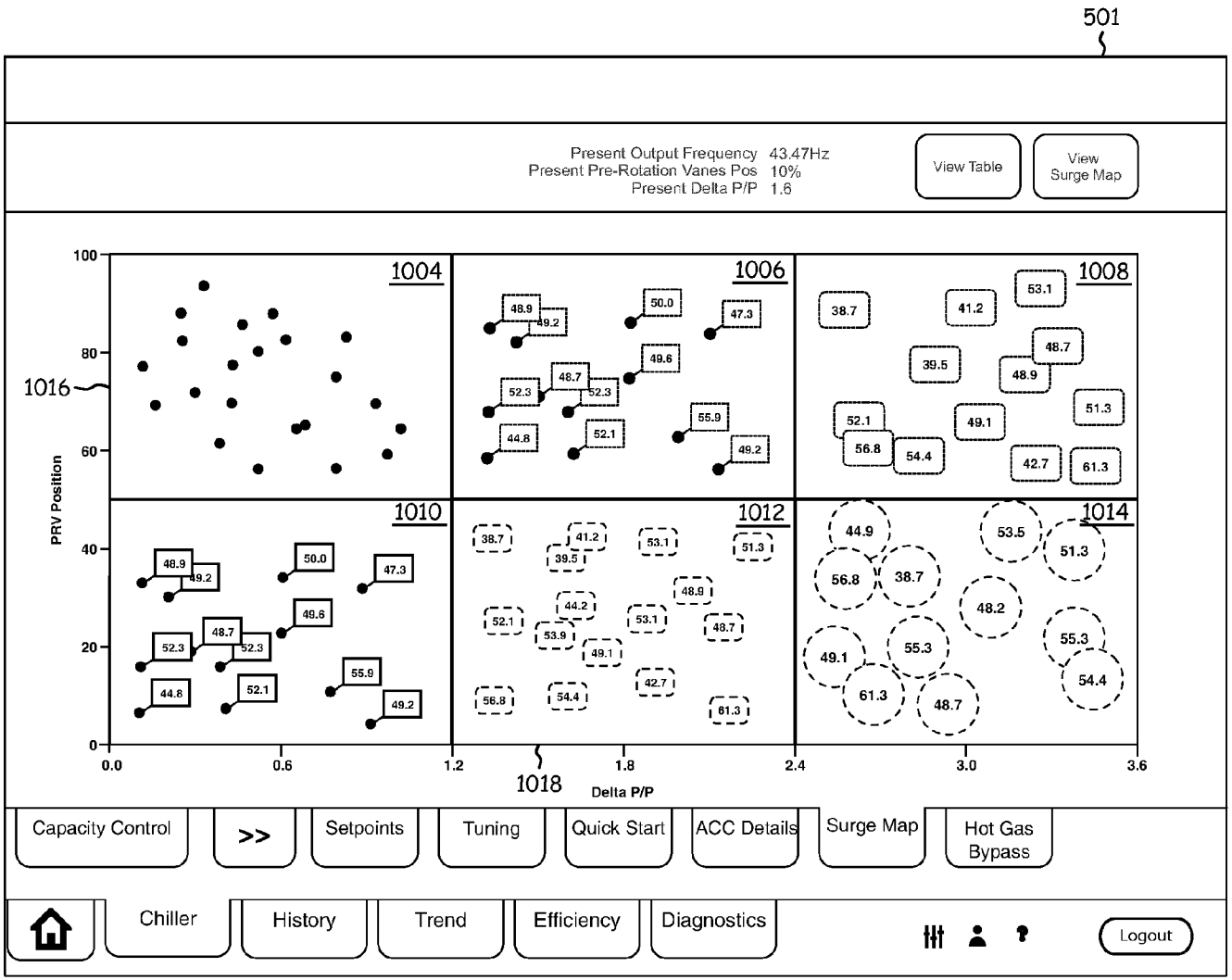
FIG. 10 is a graphical representation of at least six alternative methods for plotting surge data, according to alternative embodiments.

Referring now to FIG. 10, alternative embodiments of the surge map in FIG. 5 are shown on surge map display 501. These embodiments show different ways that chiller surge event conditions may be plotted. Dot display 1004 plots two conditions associated with a chiller surge event on a two dimensional coordinate system using two axes. The five other displays 1006, 1008, 1010, 1012, and 1014 plot two conditions (e.g., PRV position and differential pressure) using axes 1016 and 1018 and display a third condition numerically (e.g., a non-axis representation) within the surge point. Also in FIG. 10, the PRV position and differential pressure related to the chiller surge event are positioned on opposite axes from the preferred embodiment of FIG. 5.

Figure 11:
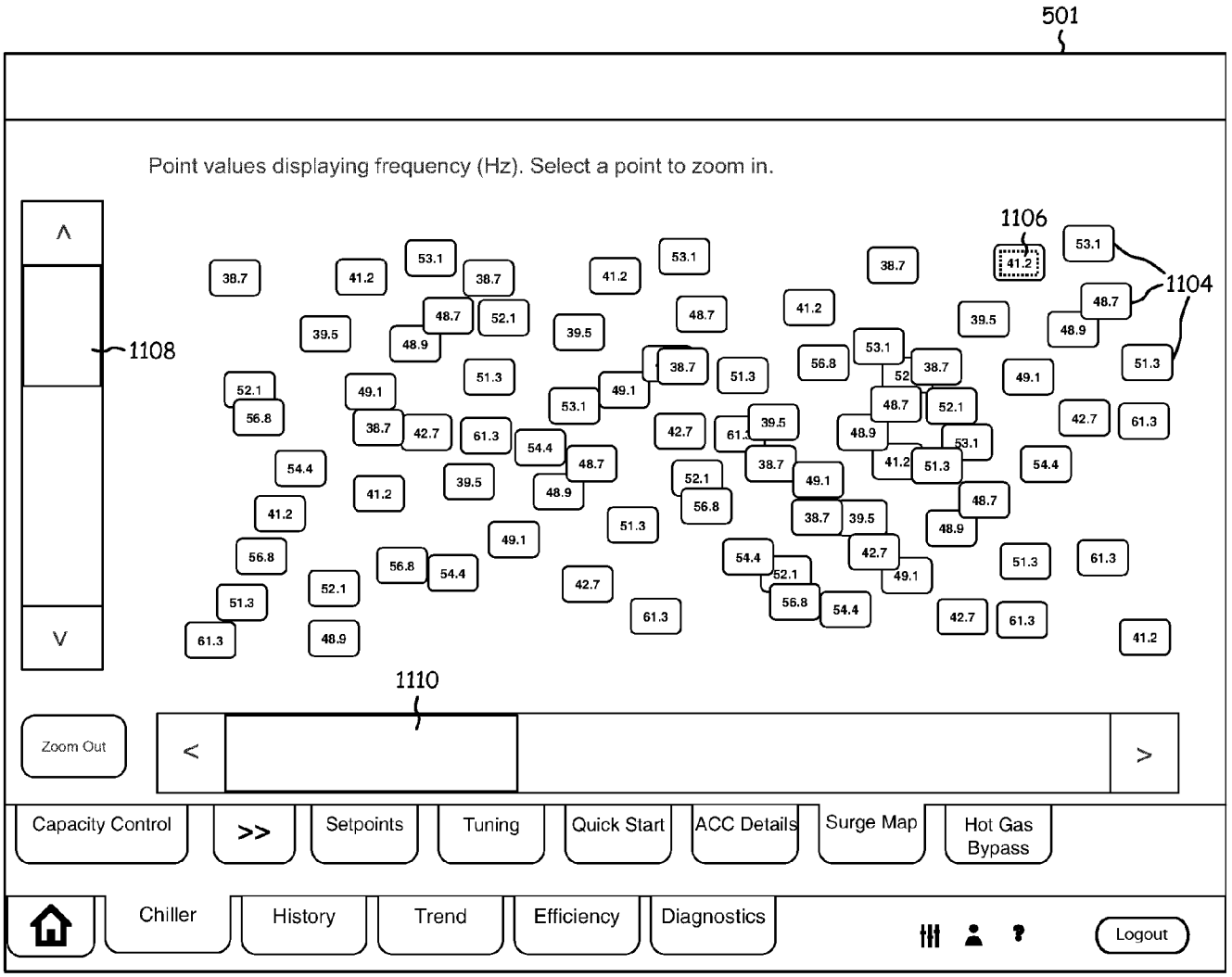
FIG. 11 is a graphical representation of an alternative method for plotting surge data, according to an alternative embodiment.

Referring now to FIG. 11, an alternative embodiment of the surge map in FIG. 5 is shown on surge map display 501. In this embodiment, surge points 1104 are plotted as squares on axes representing two surge event conditions. A third condition (VSD frequency 1106) is represented numerically (e.g., a non-axis representation) within the square. The surge points overlap in this surge map embodiment, rather than the grid representation in the preferred embodiment shown in FIG. 5. Scroll bars 1108 and 1110 may be utilized to move the surge map vertically or horizontally. This may be an alternative to the arrows utilized in the embodiment shown in FIG. 6.

Figure 12:
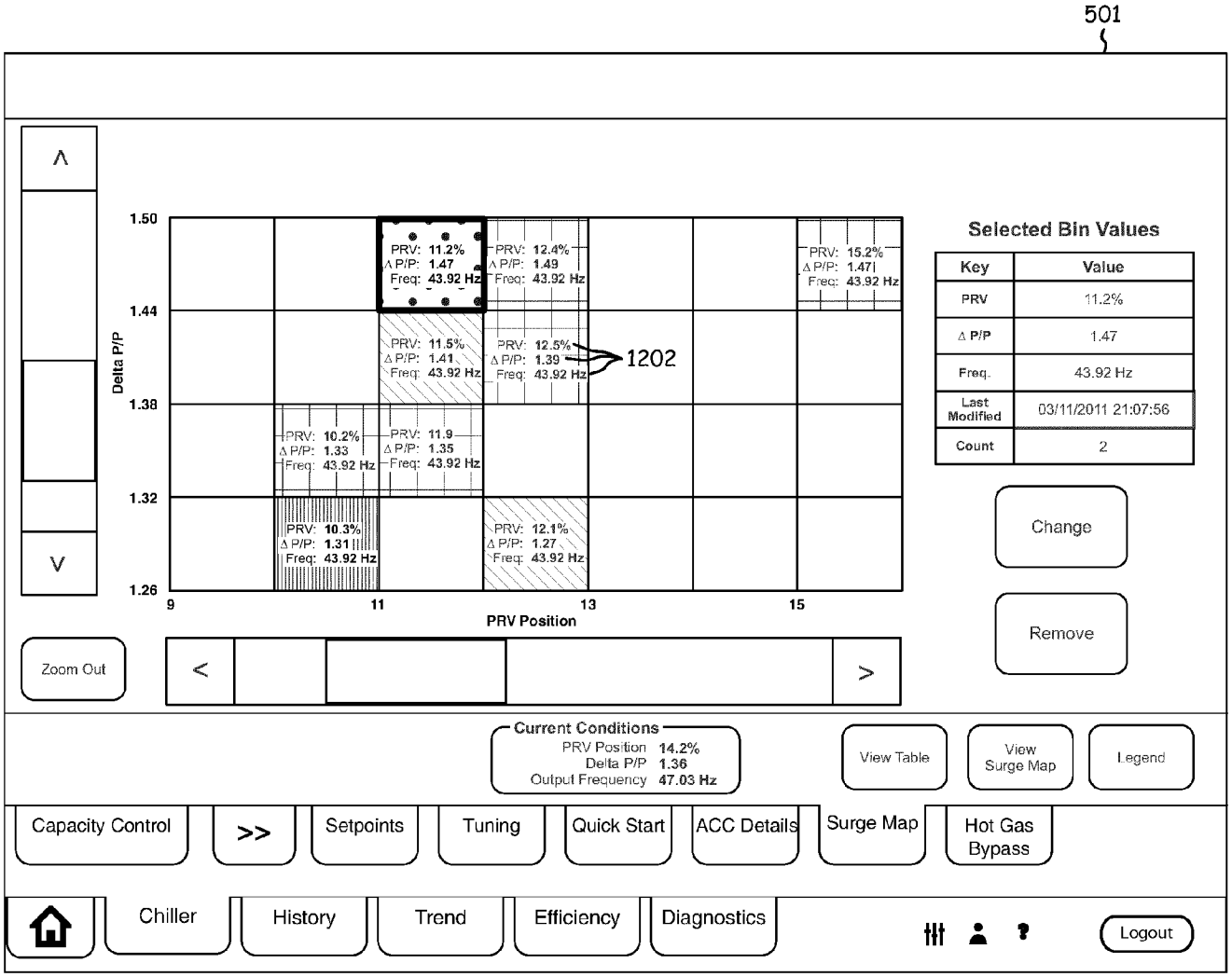
FIG. 12 is a graphical representation of a surge map displaying at least three conditions of the chiller associated with a detected surge event, according to an alternative embodiment.

Referring now to FIG. 12, another alternative surge map embodiment is shown. In this embodiment, three conditions are displayed numerically 1202 within the surge point on the surge map. However, the surge map of FIG. 12 still illustrates DP and PRV via a two-dimensional plot location. In an exemplary embodiment (not illustrated in FIG. 12), different plot patterns may be used to represent different VSD frequencies.

Figure 13:
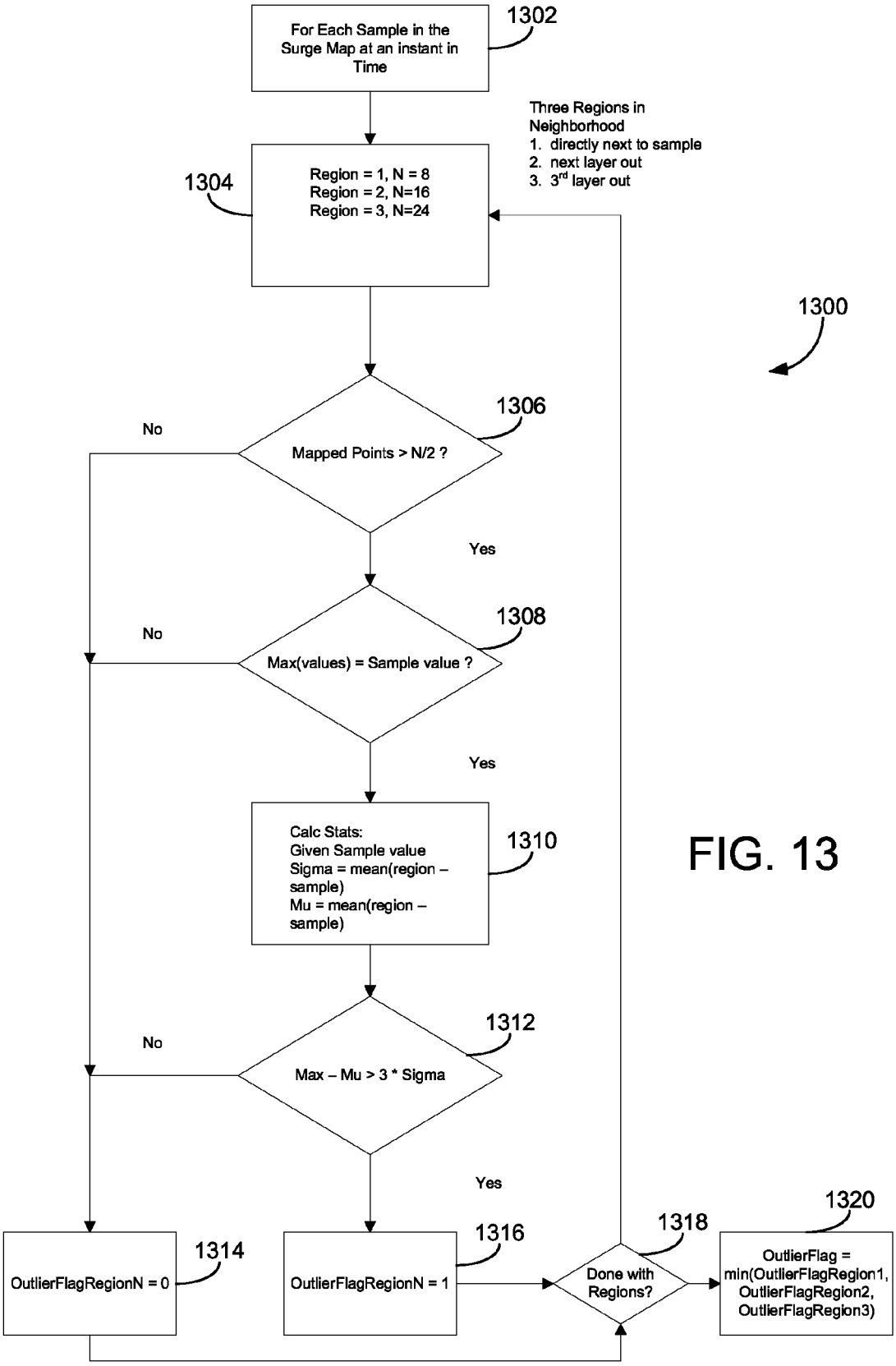
FIG. 13 is a flow chart of a process for detecting surge point outliers on a surge map, according to an exemplary embodiment.

Referring now to FIG. 13, a process 1300 for detecting surge point outliers within a surge map is shown, according to an exemplary embodiment. Process 1300 includes reading surge points within the surge map (step 1302). The process 1300 analyze the local area around the surge point on the surge map (step 1304). The process includes determining if a condition of the surge point is a local maximum (steps 1306 and 1308). The process further includes determining the mean and standard deviation of the local area surrounding the surge point (step 1310). If the chiller conditions associated with the surge points in the local surrounding area are not similar to the chiller conditions associated with the detected surge point (step 1312), the surge point is flagged as an outlier (steps 1314, 1316, and 1320). Step 1318 repeats the process with a new surge point.

In step 1302, the process is shown to include choosing a sample plotted surge point within the surge map. In step 1304, the algorithm is shown to include defining three regions surrounding the sample point on the surge map, in order to analyze the characteristics of each of the regions in relation to the sample point. The first region may be an area directly surrounding the sample, the second region may be an area surrounding and including the first region, and the third region may be an area surrounding and including the first two regions.

The process further includes determining whether there are enough surge points within the chosen region to determine whether the sample point is an outlier (step 1306). If not, the point is not flagged as an outlier within that region (e.g., since not enough data is available) (step 1314) and the process then includes testing the next region (step 1304). If there are enough surge points within the region, the process then determines whether the sample point is the maximum within the chosen region (step 1308). If not, the process tests the next region. If the sample is the maximum in that region, the process then calculates the mean and standard deviation of the surge points within the chosen region (step 1310).

The process further includes determining whether the difference between the sample point and the mean is greater than three standard deviations (step 1312). If so, the sample point is an outlier within the region (step 1316). If not, the sample point is not an outlier (step 1314). Once the process determines whether the sample point is an outlier within a region, the process determines whether all regions have been tested (step 1318). If not, the process returns to step 1304 and tests the next region. If all regions have been tested, the outlier is flagged (step 1320) if it was found to be an outlier within all regions tested.

Once the process determines that a surge point should be flagged as an outlier, that information is displayed on the surge map display 501 through the electronic display system 428. In exemplary embodiments, the outliers are highlighted or are set to blink on the electronic display system 428. The chiller operator can then edit or remove the outlier so that the surge map reflects more accurate data. In other embodiments, the processing electronics of the controller are used to remove the outliers automatically over time. Once the outliers are removed or edited, the more accurate surge event data is then used to manipulate the chiller settings to run under more energy efficient conditions without causing a surge event. The chiller operator can manipulate these settings manually, or the controller can be programmed to manipulate the settings automatically based on the surge event data.

In alternative embodiments, outliers are represented by a different shape or pattern on the surge map. For instance, while the surge points are represented by a rectangle on the surge map, outliers could be represented by a triangle. This representation distinguishes outliers from other surge points. In other embodiments, outliers are represented by a new color gradient. In these embodiments, a color gradient, such as light blue to dark blue, is used exclusively to represent outliers on the surge map (the entirety of the blue gradient may represent estimated outliers, with darker blue indicating a higher likelihood that the point is an outlier). In such an embodiment, in other words, outliers may be represented by a color outside of the red to green color key 530 that is used in the preferred embodiment. This representation may allow a viewer to easily distinguish outliers from the surge points on the surge map.

In certain embodiments, the outlier plot point changes in appearance to draw viewer attention and to indicate characteristics of the outlier surge event. In an exemplary embodiment, the blink rate of the outlier changes depending on the recency of the surge event. For instance, the outlier could blink very quickly for a recent surge event. The outlier could then blink progressively slower as time passes to indicate less recent surge events. In another embodiment, the outlier has a blinking border to differentiate it from other surge events. As above, the blinking rate of the border could change to indicate the recency of the surge event. The color of the border could also change based on the frequency of the surge point, in order to further contrast the outlier from the surrounding surge points.

Figure 14:
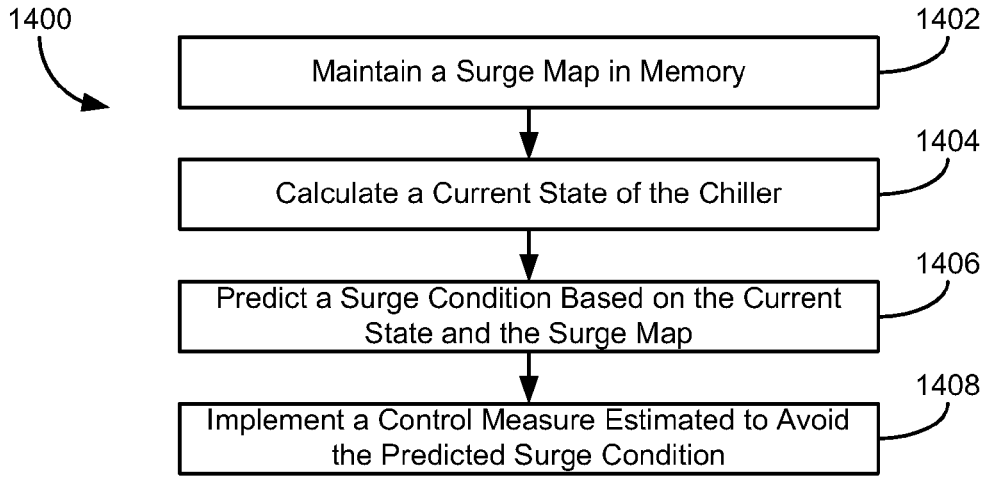
FIG. 14 is a flow chart of a process for avoiding surge conditions in a chiller using plotted chiller surge maps, according to an exemplary embodiment.

Referring now to FIG. 14, a process 1400 is shown for avoiding surge conditions in a chiller, according to an exemplary embodiment. Process 1400 includes maintaining a surge map in memory (step 1402). In some embodiments, the surge map may be constructed using process 800 shown in FIG. 8. In another embodiments, the surge map may be entirely, initially, or partially based on physical characteristics of the chiller. For example, an absolute chiller surge map floor (e.g., minimum VSD speeds for a variety of PRV and DP pairs may exist in memory (and possibly graphically) based on manufacturer-specified or physics-based parameters or calculations. In yet another embodiment, the surge map may be entirely based on historical and actual surge map data.

Process 1400 is also shown to include calculating a current state of the chiller (step 1404). The current state of the chiller may be calculated using one or more parameters received from, or provided to, the chiller. For example, the speed of the VSD, the prerotation vane position (PRV), and a differential pressure may be used to calculate the current state of the chiller. The current state of the chiller may be represented as a point in a coordinate system using the chiller's parameters as axes and/or color gradients.

Process 1400 is further shown to include predicting a surge condition based on the present operating condition (current state) and the surge map (step 1406). In one embodiment, a simple distance comparison is used to determine if the current state is near the surge point on the surge map. For example, if the distance between the current state and the surge point is decreasing over time, the chiller may be nearing a surge condition. In another embodiment, a history of chiller states can be used to estimate a location and/or a trajectory for the current state. If the trajectory approaches a surge point, the chiller may be approaching a surge condition.

Process 1400 is further shown to include implementing a control measure estimated to avoid the predicted surge condition (step 1408). A control measure may be an adjustment to one or more setpoints. Setpoints provide a target location for the current state when represented in a coordinate system. Setpoints that are directionally away from, or parallel to, a surge point defining a surge region may be used to avoid the predicted surge condition. In other embodiments, the control measure may be an immediate shutdown, startup, or non-gradual change in the operation of one or more components of the chiller.

Figure 15:
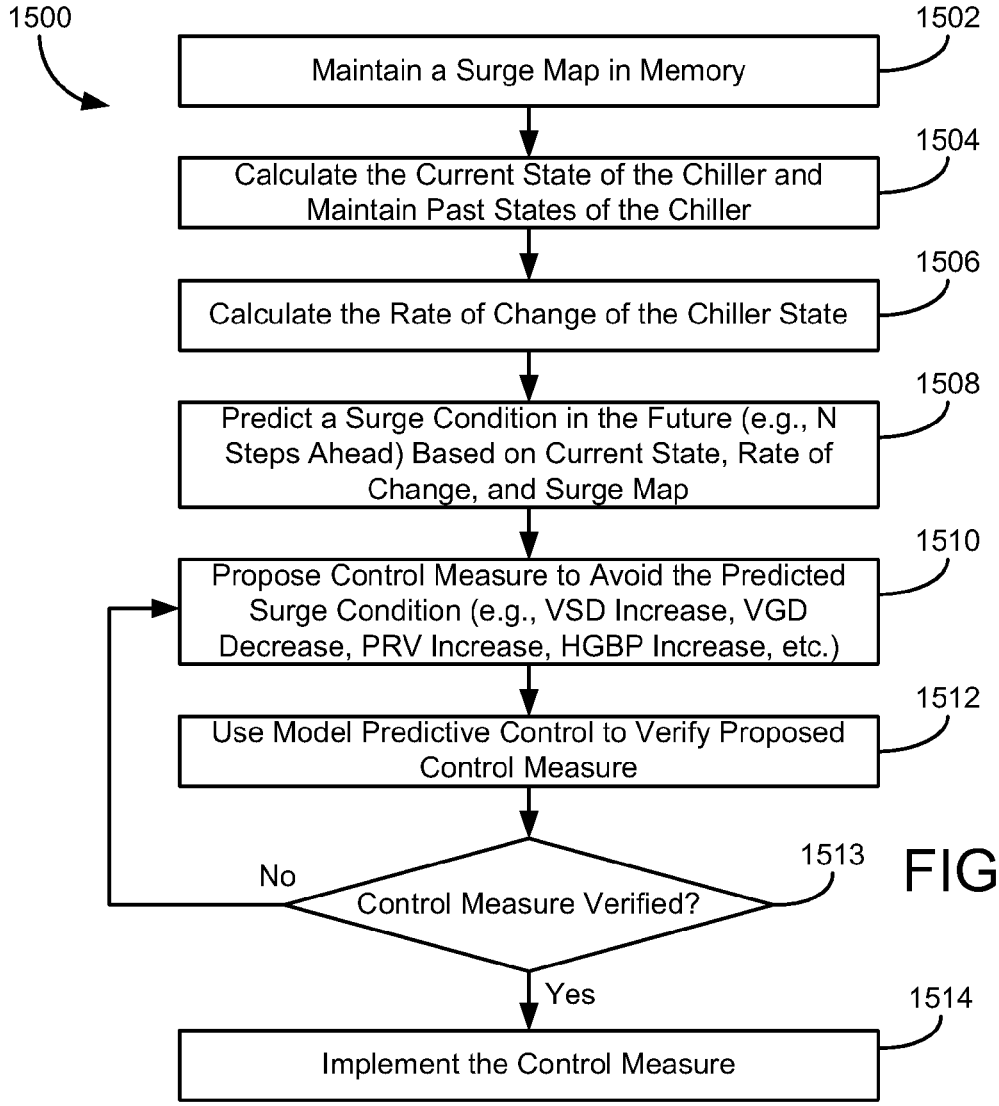
FIG. 15 is a flow chart of a process for using a map of surge points to select and implement a chiller control measure, according to an exemplary embodiment.

Referring now to FIG. 15, a process 1500 for using a surge map of surge points to select and implement a chiller control measure is shown, according to an exemplary embodiment. Process 1500 includes maintaining a surge map in memory (step 1502). Process 1500 is further shown to include calculating a current state for the chiller and maintaining past states of the chiller (e.g., in memory, in a chiller history, as time-series data, etc.) (step 1504). Using the current state of the chiller and the past states of the chiller, a rate of change of the chiller state is calculated (step 1506). The rate of change may be described on at least two axes, with respect to one of the axes, or calculated and described in other ways. A surge condition in the future may be predicted (e.g., N steps ahead, a certain number of seconds ahead, a certain number of time constants ahead, etc.) (step 1508). The prediction may be based on the current state, the calculated rate of change, directionality associated with the rate of change (e.g., in the two-dimensional coordinate system), a shift in the color gradient, and based on the plot points of the maintained surge map. When a surge condition is predicted to occur in the future, the chiller controller can process the current state, calculated rate of change, and other relevant chiller information to determine a control measure estimated to avoid the predicted surge condition. The control measure can be proposed (e.g., to a controller module that verifies the proposed control measure should avoid the surge, to an expert system that controls operation of the chiller, etc.) (step 1510). The proposed control measure can include, for example, a VSD frequency increase, a VGD decrease, a PRV increase, a hot gas bypass valve (HGBP) opening or adjustment, or a combination of control measures, a series of control measures, or any other suitable control measure or measures.

At step 1512 of process 1500, the process uses model predictive control (or another methodology for conducting testing or simulation) to verify that the control measure proposed at step 1510 is expected to avoid the predicted surge. Output from decision step 1513 can cause implementation of the control measure at step 1514 (e.g., if the control measure is verified as expected to avoid the predicted surge condition). If the model predictive control indicates that the proposed control measure is still predicted to cause a surge, the process 1500 can loop back to step 1510 and a different control measure may be selected for verification and potential implementation. In this way, even if the first selected control measure is not estimated to result in an avoided surge, the controller can try another control measure. At step 1514, the controller operating based on process 1500 can implement the control measure (e.g., send proper values or control signals to components of the chiller such as the variable speed drive).

Figure 16:
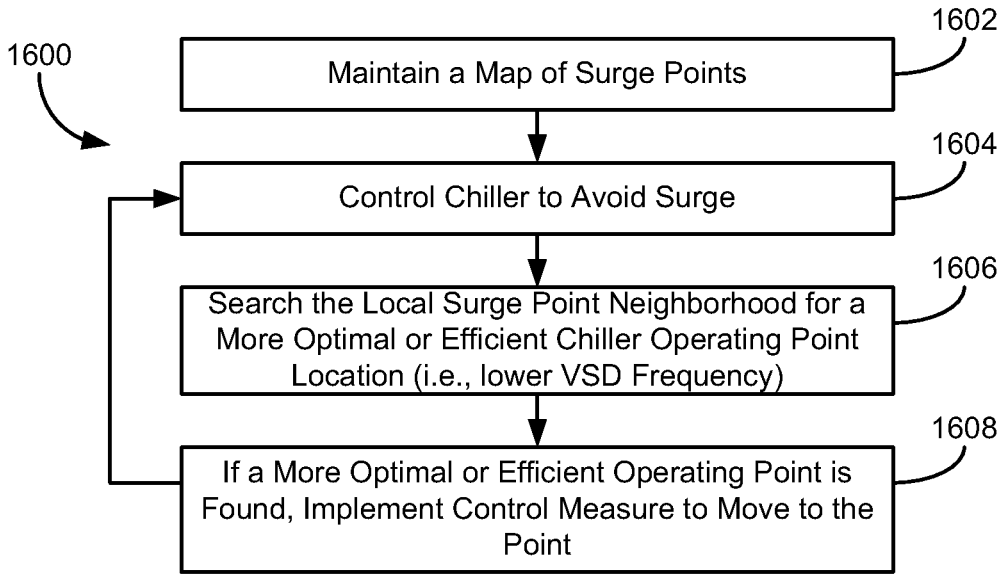
FIG. 16 is a flow chart of a process for finding an energy efficient operating point for a chiller, according to an exemplary embodiment.

Referring now to FIG. 16, a process 1600 for finding an energy efficient operating point for a chiller is shown, according to an exemplary embodiment. Process 1600 is shown to include maintaining a surge map of surge points (e.g., actual, generated, etc.) (step 1602). Process 1600 can generally include controlling the chiller to avoid surges (step 1604). During control of the chiller (e.g., periodically, continuously, in response to one or more conditions, in the absence of a demand signal from a utility, etc.) the controller can search the local surge point neighborhood for a more optimal or efficient chiller operating point location (step 1606). The local surge point neighborhood can be defined in different ways according to different embodiments. For example, in one embodiment, the neighborhood is defined in terms of a differential pressure and prerotation vane radius of some predetermined amount around the current operating point. Within the radius, for example, the controller may search for the lowest VSD frequency. If a more optimal or efficient operating point is found, the controller can then implement one or more control measures to move the chiller's operation to the identified point (step 1608). The one or more control measures may include, for example, moving the PRV position until the lowest VSD frequency identified in the search of step 1606 is reached.

Figure 17:
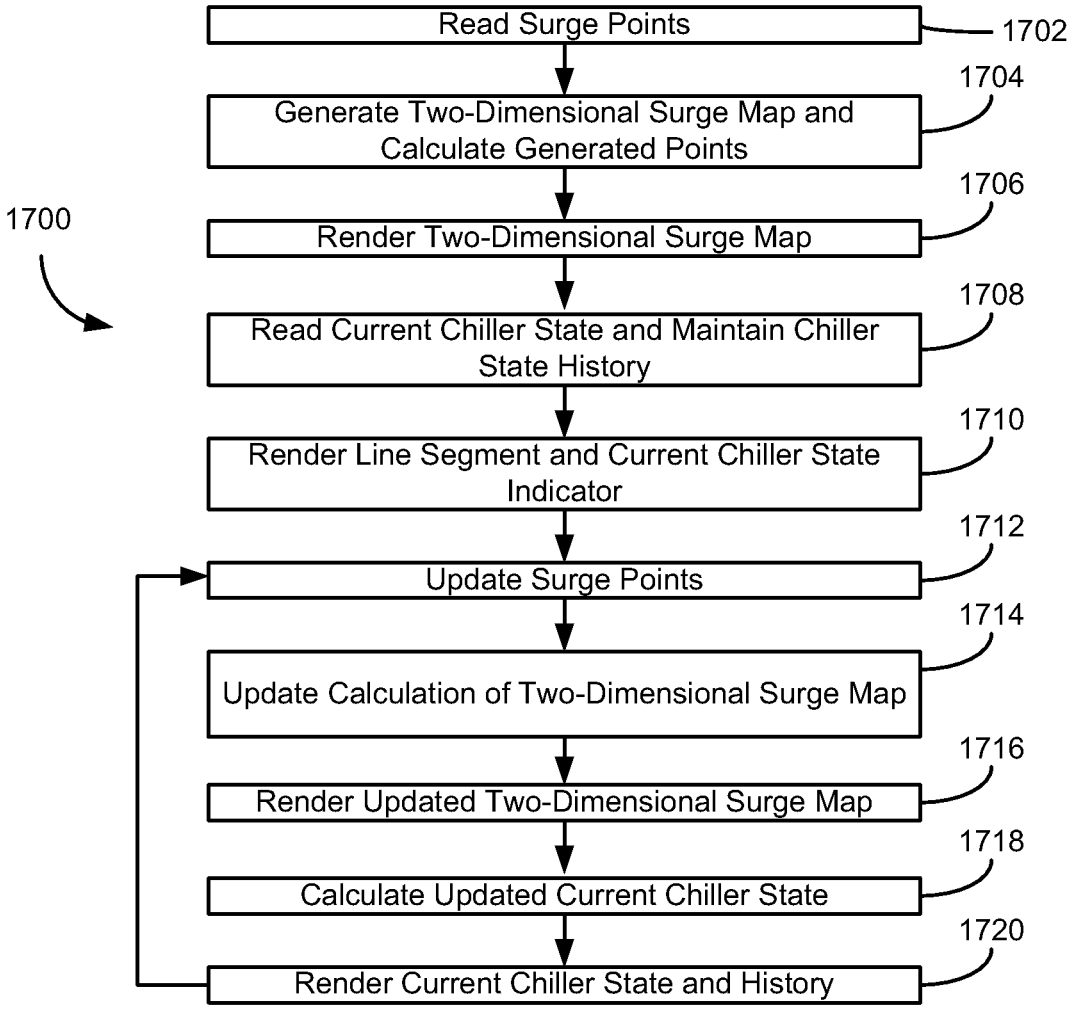
FIG. 17 is a flow chart of a process for using surge maps with a graphical rendering for an electronic display, according to an exemplary embodiment.

Referring now to FIG. 17, a process 1700 for using surge maps with a graphical rendering for an electronic display is shown, according to an exemplary embodiment. Process 1700 includes reading surge points (step 1702) (e.g., from memory, from a surge history, from a surge detection module, etc.). A two-dimensional surge map with color gradient is then plotted (step 1704). The surge map may be plotted from data within the surge history, from one or more curve fitting tasks, by estimating one or more generated surge points, or as otherwise described in the present disclosure. The surge map may then be rendered at step 1706. Any computerized or graphical rendering technique of the past, present, or future may be used.

At step 1708 of FIG. 17, process 1700 can read the current chiller state and maintain a state history for the chiller. Based on the read information, a current state indicator (e.g., an icon, a point, etc.) can be rendered on the two-dimensional coordinate system with the surge map (step 1710). The surge points can be updated (step 1712) and the calculation of the surge map can be updated (step 1714). The updated surge map can then be rendered (step 1716). An updated current chiller state can be calculated (step 1718) and the current chiller state and history can be rendered (step 1720). For example, the current chiller state can be shown with a point and an updated history trail showing the last chiller state position. The history trail may have an end (e.g., distal the current chiller state point) that expires or disappears such that the history trail only shows the past M chiller states or chiller states over the past X minutes.

Many of the embodiments discussed herein may result in a graphical depiction of the surge map on a graphical user interface on an electronic display system. The surge map may also be stored in memory and used by a control algorithm of the chiller controller even if not displayed. In some embodiments the graphical representation may be manipulated using a user input device (e.g., mouse, joystick, multi-touch, etc.). The surge map may be transparent. In some embodiments multiple surge maps may be shown (an old surge map, a most recent surge map, a benchmark surge map for like chillers, etc.). In some embodiments an x, y, z printout or other indicator may be provided to a user as the user selects various points on the map.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A computerized method for controlling a chiller, comprising:

using processing electronics of a controller for the chiller to detect a plurality of chiller surge events;

using the processing electronics to create a surge map by calculating and plotting a point for each detected surge event in an at least two dimensional coordinate system that describes conditions of the chiller associated with the detected surge event;

wherein two conditions of the chiller associated with the detected surge event are described in the at least two dimensional coordinate system by two distinct axes;

wherein a third condition of the chiller associated with the detected surge event is described in the at least two dimensional coordinate system by a non-axis graphical representation;

causing an electronic display to display the surge map;

using the processing electronics to identify an outlier plotted on the surge map, wherein identifying the outlier plotted on the surge map comprises:

evaluating a first region surrounding a potential outlier and determining whether the point is a maximum in any of the three graphically represented chiller conditions;

in response to a determination that the point is a maximum, subtracting the point from the mean of all points within the first region; and identifying the potential point as the outlier in response to a determination that the result of the subtraction is greater than three standard deviations within the first region; and causing the electronic display to graphically identify the outlier on the surge map.

2. The computerized method of claim 1, further comprising:

receiving user input representative of a selection of the graphically identified outlier;

causing the electronic display to show an option for removing the selected and graphically identified outlier; and in response to receiving user input for the removal of the selected and graphically identified outlier, modifying or removing the data associated with the detected surge event such that the outlier is no longer used for control of the chiller or shown on the surge map.

3. The computerized method of claim 1, further comprising:

refraining from using the identified outlier in the control of the chiller.

4. The computerized method of claim 1, further comprising:

receiving user input representative of a selection of the graphically identified outlier;

causing the electronic display to show an option for modifying the selected and graphically identified outlier; and in response to receiving user input for the modification of the selected and graphically identified outlier updating the data associated with the detected surge event such that control of the chiller is conducted based on the updated data and the point is moved on the surge map to a plot point associated with the updated data.

5. The computerized method of claim 1, further comprising:

evaluating a second region, larger than the first region, if a minimum number of points do not exist within the second region.

6. The computerized method of claim 1, further comprising using the processing electronics to control at least one setpoint for the chiller using the plotted surge map.

7. The computerized method of claim 1, wherein the non-axis graphical representation is color.

8. The computerized method of claim 1, further comprising:

receiving, at the processing electronics, user input signals from a user input device and using the user input signals to manipulate the surge map; and causing the display system to display magnified portions of the surge map.

9. The computerized method of claim 1, wherein the plotted points are represented on the at least two dimensional coordinate system with grid lines forming separate and discrete positions for each point.

10. The computerized method of claim 1, further comprising:

calculating a current state of the chiller;

predicting an upcoming surge condition based on the current state and the surge map; and implementing a control measure estimated to avoid the predicted surge condition.

11. A controller for a chiller comprising:

processing electronics configured to detect a plurality of surge events and to create a surge map by calculating and plotting a point for each detected surge event in an at least two dimensional coordinate system that describes conditions of the chiller when the surge event was detected;

wherein the processing electronics are configured to calculate and describe two conditions of the chiller associated with the detected surge event in the at least two dimensional coordinate system by two distinct axes;

wherein the processing electronics are configured to calculate and describe one condition of the chiller associated with the detected surge event in the at least two dimensional coordinate system by a non-axis representation;

wherein the controller is configured to cause an electronic display to display the surge map;

wherein the processing electronics are configured to identify an outlier plotted on the surge map, wherein identifying the outlier plotted on the surge map comprises:

evaluating a first region surrounding a potential outlier and determining whether the point is a maximum in any of the three graphically represented chiller conditions;

in response to a determination that the point is a maximum, subtracting the point from the mean of all points within the first region; and identifying the potential point as the outlier in response to a determination that the result of the subtraction is greater than three standard deviations within the first region; and wherein the processing electronics are configured to cause the electronic display to graphically identify the outlier on the surge map.

12. The controller of claim 11, wherein the processing electronics are configured to receive user input representative of a selection of the graphically identified outlier and to cause the electronic display to show an option for removing the selected and graphically identified outlier; and in response to receiving user input for the removal of the selected and graphically identified outlier, the processing electronics modify or remove the data associated with the detected surge event such that the outlier is no longer used for control of the chiller or shown on the surge map.

13. The controller of claim 11, wherein the processing electronics are configured to refrain from using the identified outlier in the control of the chiller.

14. The controller of claim 11, wherein the processing electronics are configured to receive user input representative of a selection of the graphically identified outlier;

wherein the processing electronics are further configured to cause the electronic display to show an option for modifying the selected and graphically identified outlier; and in response to receiving user input for the modification of the selected and graphically identified outlier, the processing electronics update the data associated with the detected surge event such that control of the chiller is conducted based on the updated data and the point is moved on the surge map to a plot point associated with the updated data.

15. The controller of claim 11, wherein the processing electronics are configured to evaluate a second region as a part of the potential outlier evaluation, larger than the first region, if a minimum number of points do not exist within the second region.

16. The controller of claim 11, wherein the non-axis representation is color and wherein the plotted points are represented on the at least two dimensional coordinate system with grid lines forming separate and discrete positions for each point.

* * * * *